US011555359B2

(12) United States Patent
Hern et al.

(10) Patent No.: US 11,555,359 B2
(45) Date of Patent: Jan. 17, 2023

(54) PASS-THROUGH TAPERED NOSE TOOL

(71) Applicants: Christopher Hern, Porter, TX (US); Shane Harris, Cypress, TX (US); Kirby Schrader, Magnolia, TX (US); Marc Samuelson, Houston, TX (US); Scott Christopher, Houston, TX (US); Daniel Ewing, Katy, TX (US)

(72) Inventors: Christopher Hern, Porter, TX (US); Shane Harris, Cypress, TX (US); Kirby Schrader, Magnolia, TX (US); Marc Samuelson, Houston, TX (US); Scott Christopher, Houston, TX (US); Daniel Ewing, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/379,497

(22) Filed: Jul. 19, 2021

(65) Prior Publication Data

US 2022/0018218 A1 Jan. 20, 2022

Related U.S. Application Data

(60) Provisional application No. 63/122,079, filed on Dec. 7, 2020, provisional application No. 63/054,097, filed on Jul. 20, 2020.

(51) Int. Cl.
*E21B 17/14* (2006.01)
*E21B 23/00* (2006.01)
(Continued)

(52) U.S. Cl.
CPC ..... *E21B 17/14* (2013.01); *E21B 23/00* (2013.01); *E21B 34/063* (2013.01); *E21B 34/14* (2013.01)

(58) Field of Classification Search
CPC ..... E21B 34/14; E21B 23/00; E21B 17/14; E21B 31/20; E21B 23/10; E21B 23/01;
(Continued)

(56) References Cited

U.S. PATENT DOCUMENTS 1,304,167 A 5/1919 Dunham
4,175,619 A 11/1979 Davis
(Continued)

FOREIGN PATENT DOCUMENTS

CN 105840116 A 8/2016
CN 107201879 A 9/2017
(Continued)

OTHER PUBLICATIONS

Notification of Transmittal of the International Search Report and the Written Opinion of the International Searching Authority, or the Declaration; PCT/US2021/042297; dated Nov. 2, 2021; 9 pages.
(Continued)

*Primary Examiner* — Michael R Wills, III
(74) *Attorney, Agent, or Firm* — Cantor Colburn LLP

(57) ABSTRACT

A tapered nose tool includes a housing, a retrievable tapered nose disposed in the housing and retrievable from the housing, and a mechanically shiftable sleeve. The mechanically shiftable sleeve is shiftable with a shifting profile disposed in the housing. The sleeve anchors the nose in the housing in a first position and releases the nose from the housing in a second position.

14 Claims, 47 Drawing Sheets

(51) Int. Cl.
*E21B 34/14* (2006.01)
*E21B 34/06* (2006.01)

(58) Field of Classification Search
CPC ... E21B 29/10; E21B 33/1293; E21B 33/1294
See application file for complete search history.

(56) References Cited

U.S. PATENT DOCUMENTS

| | | | | |
|---|---|---|---|---|
| 5,488,999 | A | 2/1996 | Serrette | |
| 5,570,748 | A | 11/1996 | Serrette | |
| 6,062,326 | A | 5/2000 | Strong et al. | |
| 6,269,891 | B1 | 8/2001 | Rujnia | |
| 2003/0183424 | A1 | 10/2003 | Tulloch | |
| 2004/0040704 | A1 | 3/2004 | Baker | |
| 2008/0110636 | A1 | 5/2008 | Anderson et al. | |
| 2008/0156479 | A1 | 7/2008 | Cassidy et al. | |
| 2008/0173481 | A1 | 7/2008 | Menezes et al. | |
| 2011/0024135 | A1* | 2/2011 | Noel | E21B 43/105 166/384 |
| 2016/0201427 | A1 | 7/2016 | Fripp et al. | |
| 2018/0179864 | A1 | 6/2018 | Mitchell et al. | |
| 2019/0145187 | A1* | 5/2019 | Steine | E21B 17/1064 166/380 |
| 2021/0404275 | A1* | 12/2021 | Rodriguez | E21B 31/20 |
| 2022/0049573 | A1* | 2/2022 | Jacob | E21B 33/134 |

FOREIGN PATENT DOCUMENTS

| | | | |
|---|---|---|---|
| GB | 2223829 | A | 4/1990 |
| WO | 9528545 | A1 | 10/1995 |
| WO | 2008015402 | A2 | 2/2008 |
| WO | 2011014565 | A2 | 2/2011 |
| WO | 2011025488 | A1 | 3/2011 |

OTHER PUBLICATIONS

Notification of Transmittal of the International Search Report and the Written Opinion of the International Searching Authority, or the Declaration; PCT/US2021/042434; dated Nov. 12, 2021; 9 pages.
Notification of Transmittal of the International Search Report and the Written Opinion of the International Searching Authority, or the Declaration; PCT/US2021/042995; dated Nov. 8, 2021; 11 pages.

* cited by examiner

PASS-THROUGH TAPERED NOSE TOOL

CROSS REFERENCE TO RELATED APPLICATIONS

This application claims the benefit of an earlier filing date from U.S. Provisional Application Ser. No. 63/054,097 filed Jul. 20, 2020 and from U.S. Provisional Application Ser. No. 63/122,079, filed on Dec. 7, 2020, the entire disclosure of which is incorporated herein by reference.

BACKGROUND

In the resource recovery industry, it is often necessary to join two strings together to complete a wellbore system. The industry makes use of tapered nose tools, such as "bull nose" tools (generally considered closed end tapered tools) and guide shoes (generally considered open end tapered nose tools) in order to improve alignment and bring the two strings into concentricity with one another when joining them together. Such bull nose tools work well and are ubiquitously employed. The shortfall of bull nose tools is that thru tubing and well intervention methods are no longer able to be performed past the bull nose since its profile closes off the well bore. As wells have become increasingly complex and sensitive however, guide shoes are becoming more critical to protect the upward facing profile of the downhole tool string. Simple solutions such as half mule guide shoes are not appropriate in some situations due to potential damage and the inability to rotate the upper tool string. The proposed devices are several configurations that eliminate or mitigate some risks associated with standard mule guide shoes and allow for the capabilities of bull nose tools while being able to perform future tasks down hole of the guide shoe.

SUMMARY

A tapered nose tool having a closed position and an open position.

A tapered nose tool having a degradable nose component.

A tapered nose tool having a releasable nose component.

A tapered nose tool configured to rotate due to fluid passing therethrough.

A tapered nose tool configured for retrievability of a portion of the bull nose tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed herein are several embodiments of a tapered nose tool. In each embodiment, the tool provides not only the function of a traditional bull nose tool or guide shoe of helping direct a string through sensitive downhole profiles but additionally the ability to allow passage of through-tubing tools. This is of great benefit to the art since it reduces risk and enables later action to be taken on the well's lower completion.

Referring to FIGS. 1-4, a first embodiment of a tapered nose tool is illustrated. As will be appreciated by one of skill in the art, in the running position, a tapered nose tool 10 acts identically to a traditional bull nose tool by allowing negotiation of profiles and hang-up points much more easily than a string without a bull nose tool. The tapered nose tool 10 as disclosed herein differs in that it is also configurable to an open position shown in FIG. 2 to remove any impediment to through-tubing operations.

Figure 1:
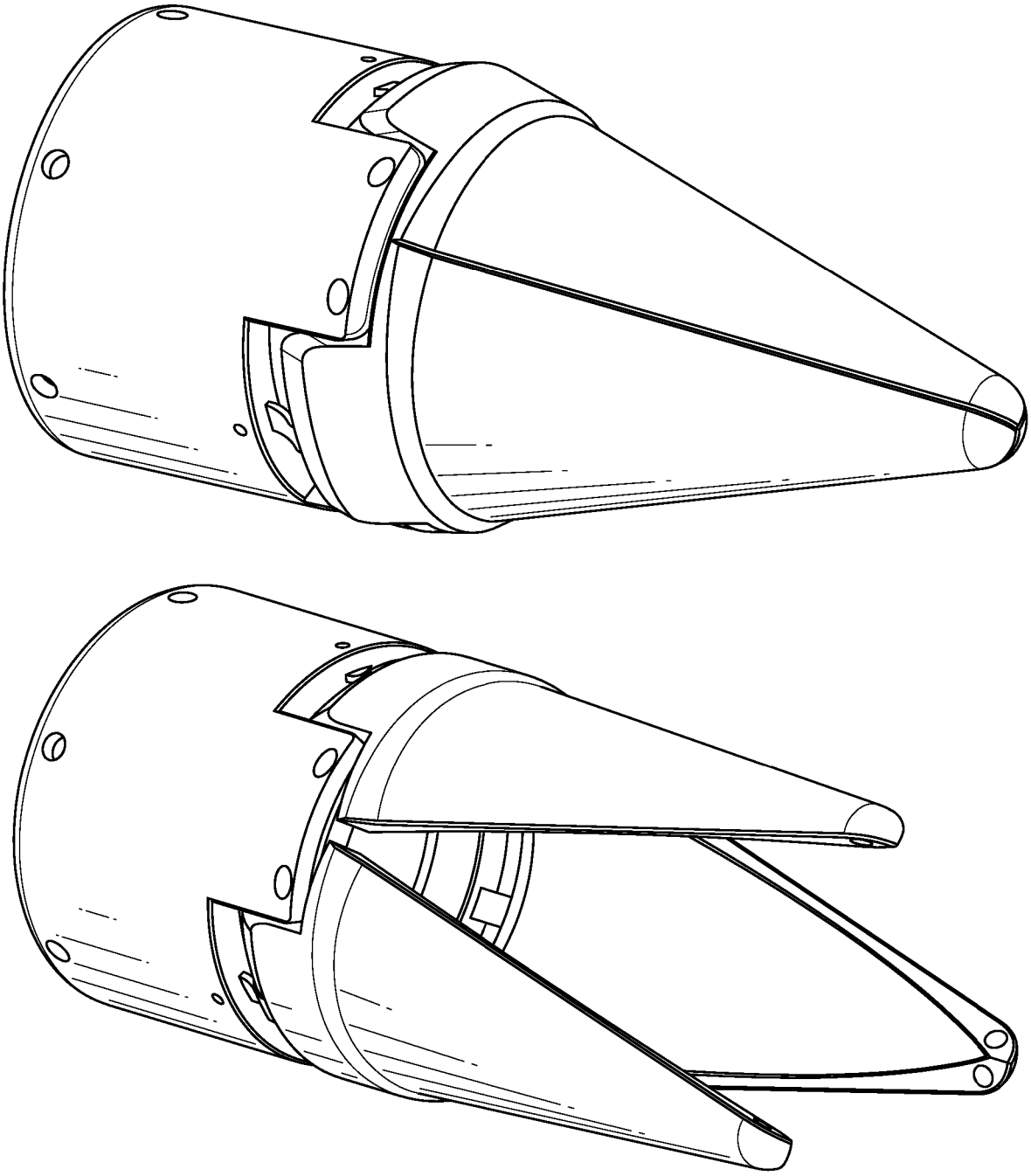
FIG. 1 is a perspective view of an embodiment of a tapered nose tool in a running condition.
Figure 2:
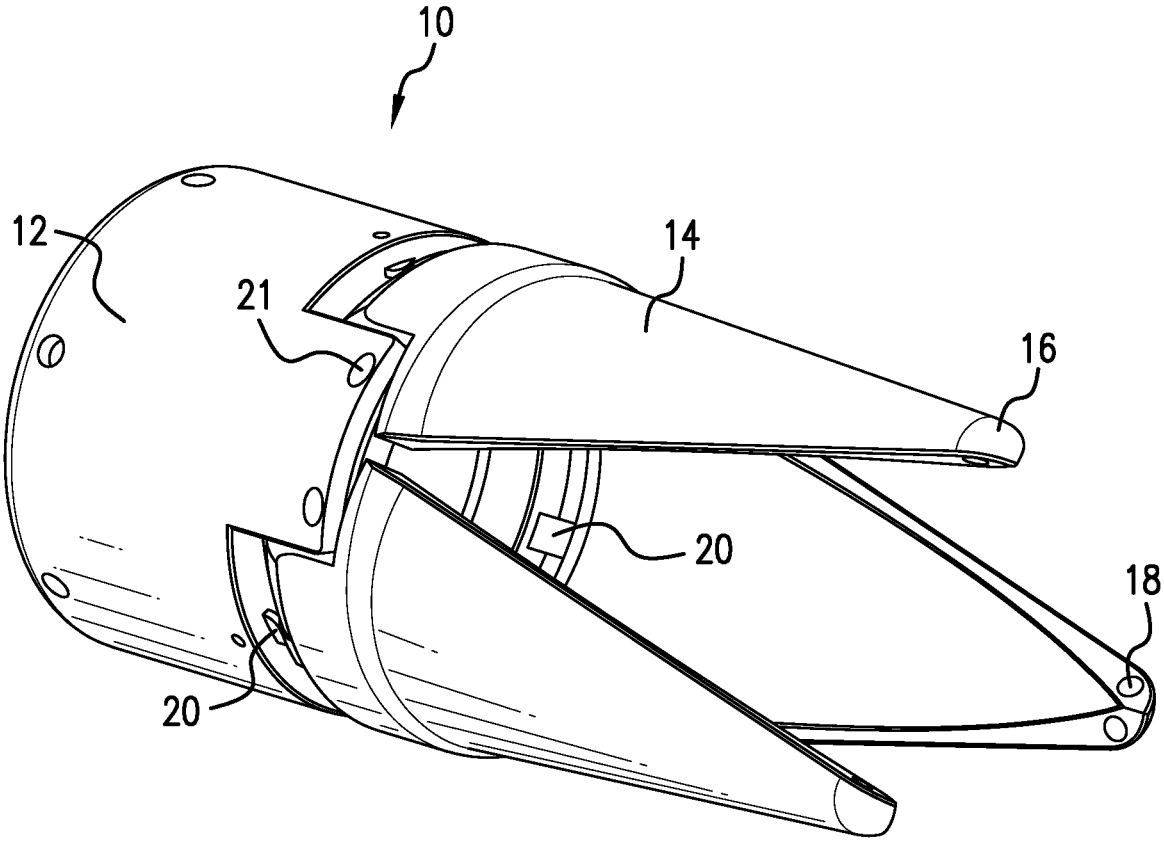
FIG. 2 is a perspective view of the tool shown in FIG. 1 in a pass-through condition.
Figure 3:
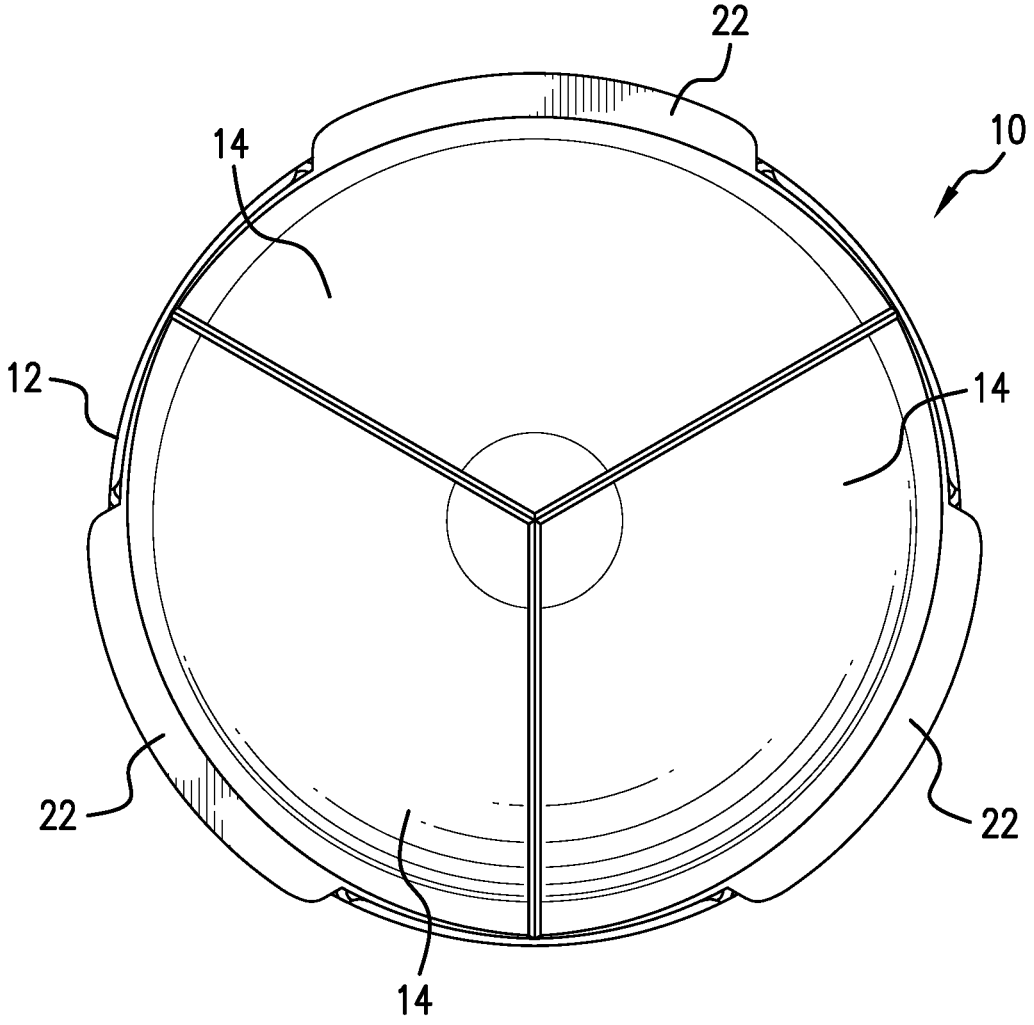
FIG. 3 is an end view of the tool shown in FIG. 1 in the running condition.
Figure 4:
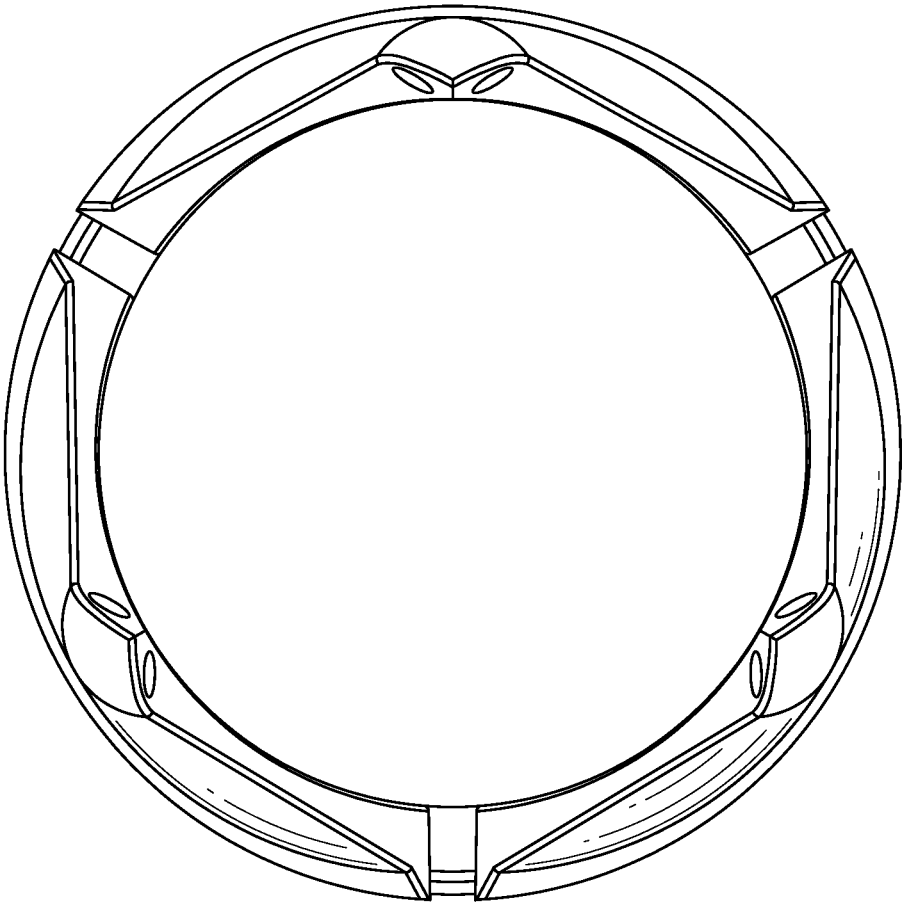
FIG. 4 is an end view of the tool shown in FIG. 1 in the pass-through (open) condition.
Figure 5:
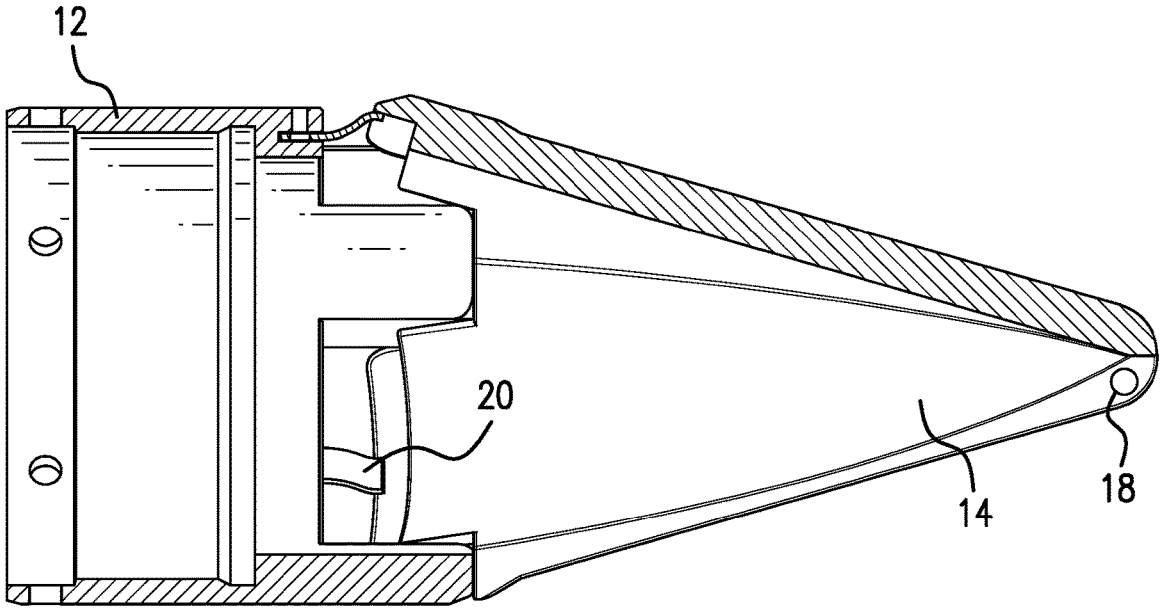
FIGS. 5 and 6 illustrate cross section views of the tool of FIG. 1.
Figure 6:
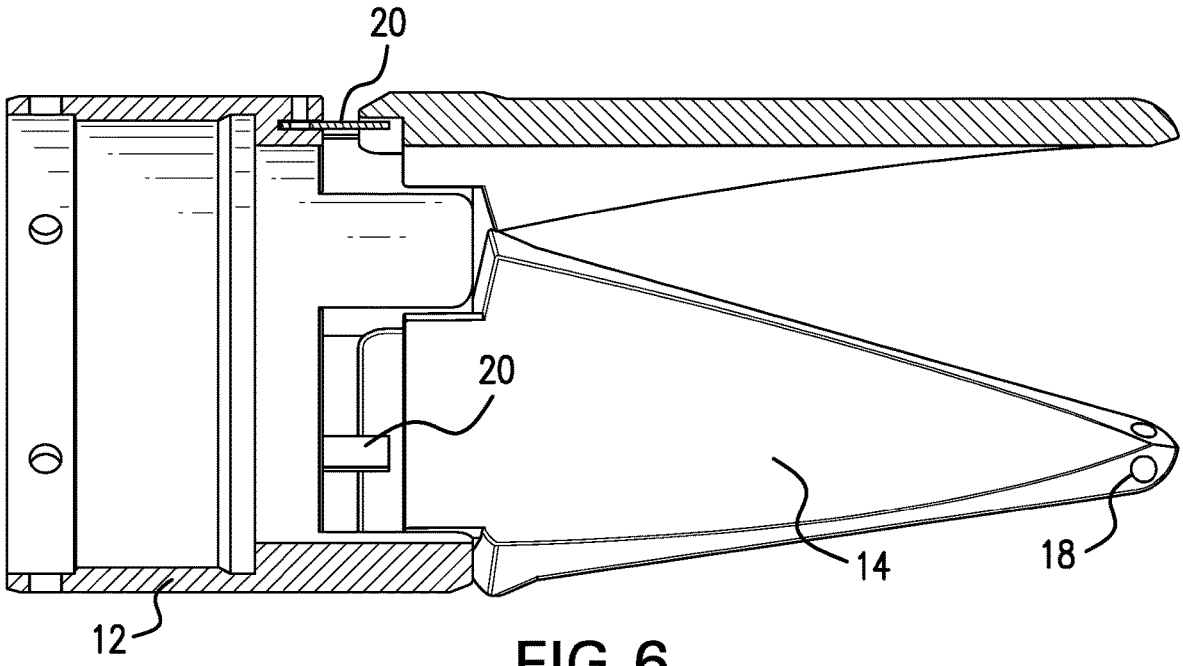
Figure 7:
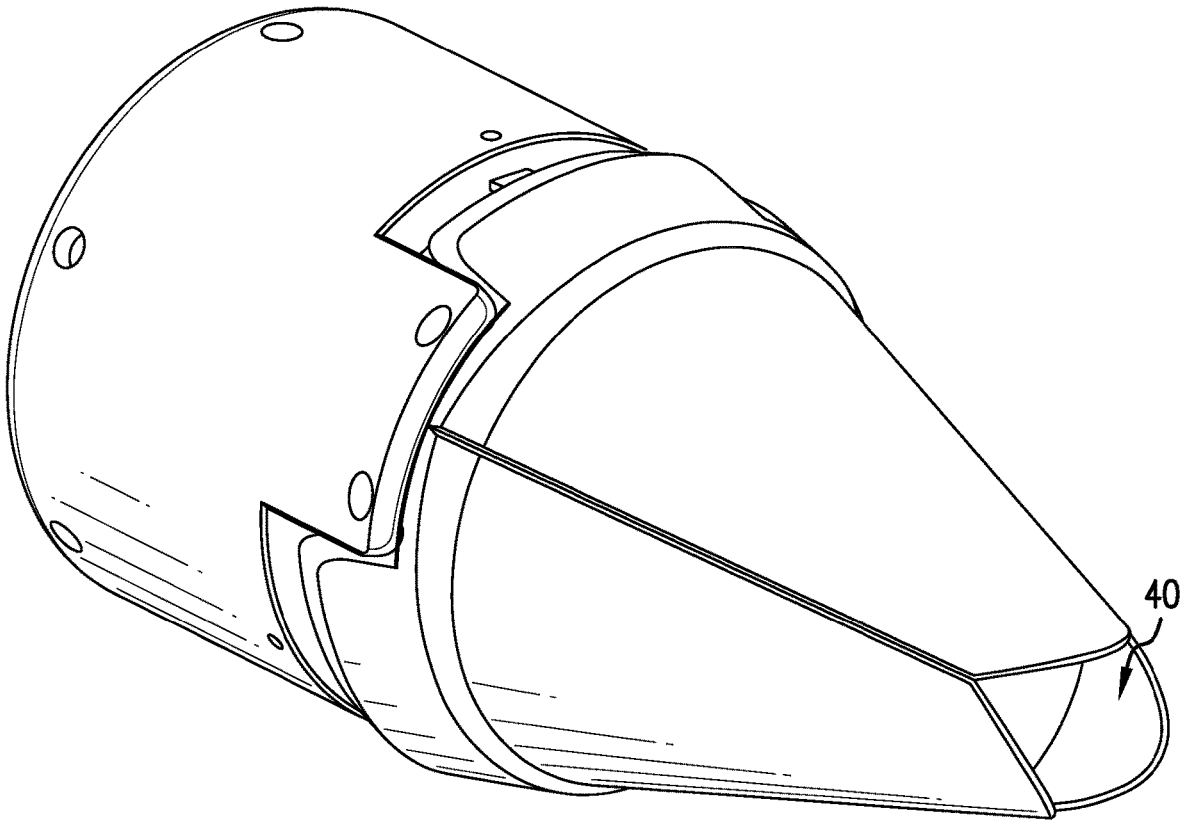
FIG. 7 illustrated an alternate embodiment of a tool similar to FIG. 1 in a running position.
Figure 8:
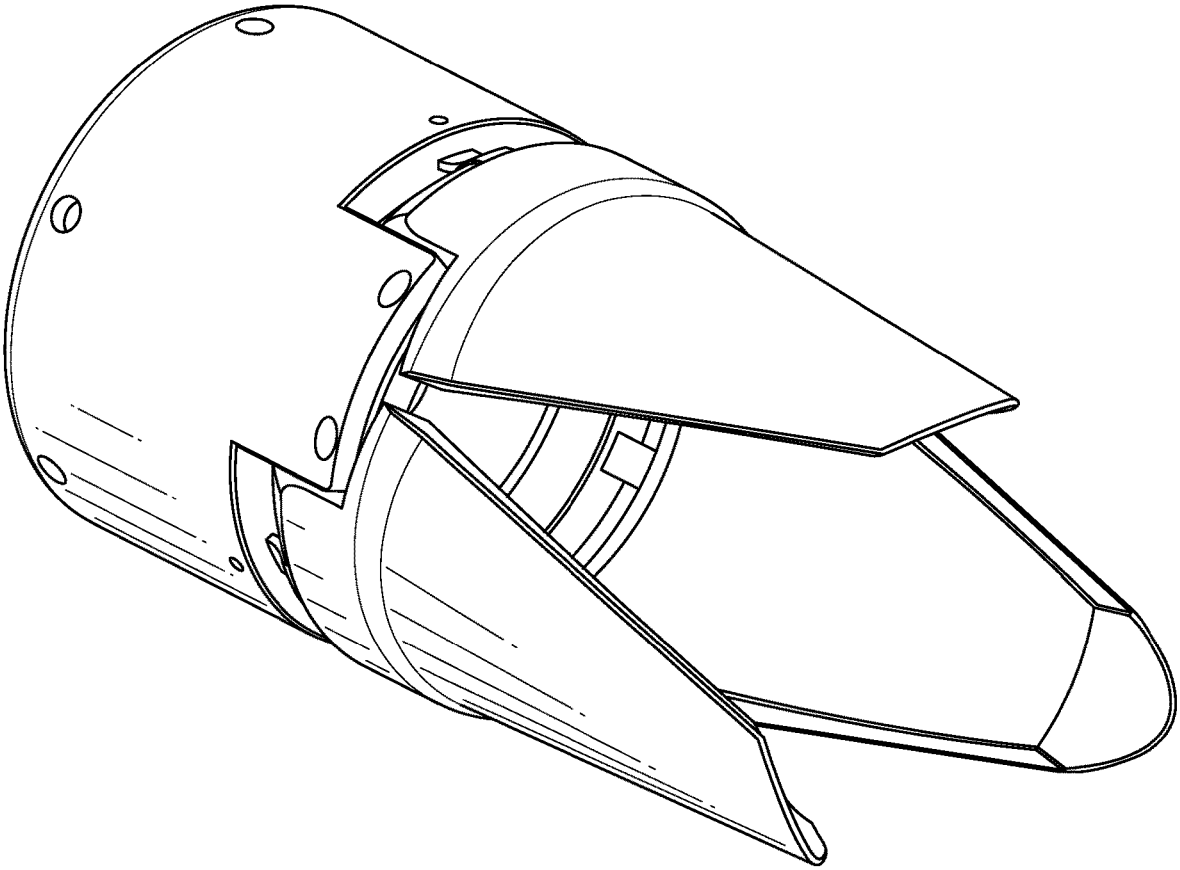
FIG. 8 is the tool of FIG. 7 in an open position.
Figure 9:
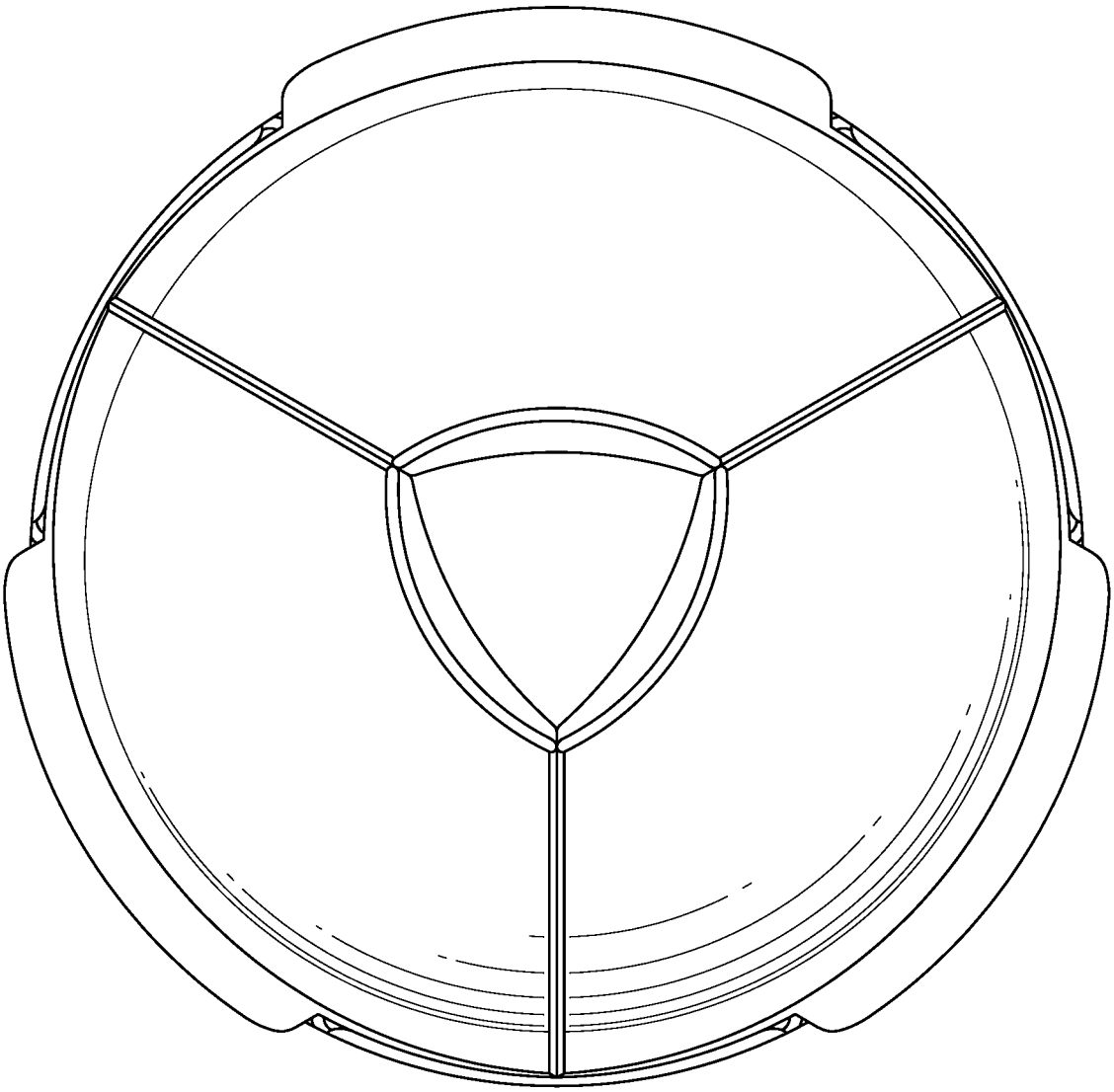
FIG. 9 is an end view of the tool shown in FIG. 7 in the running condition.
Figure 10:
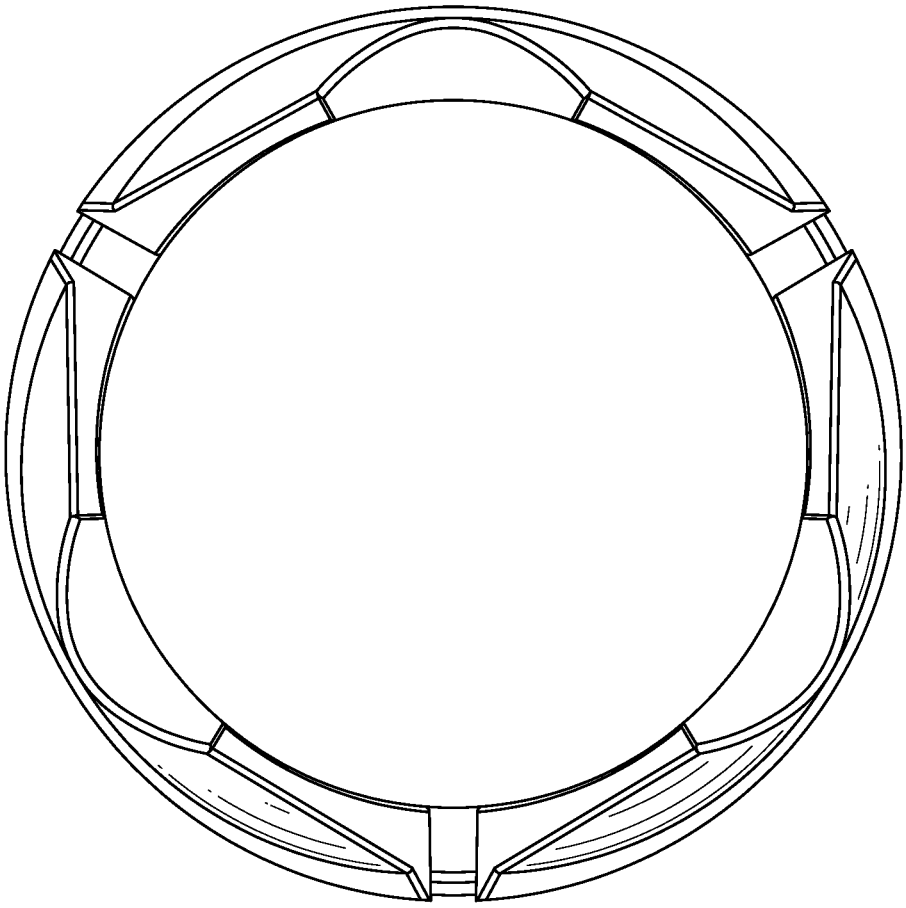
FIG. 10 is an end view of the tool shown in FIG. 7 in the pass-through (open) condition.
Figure 11:
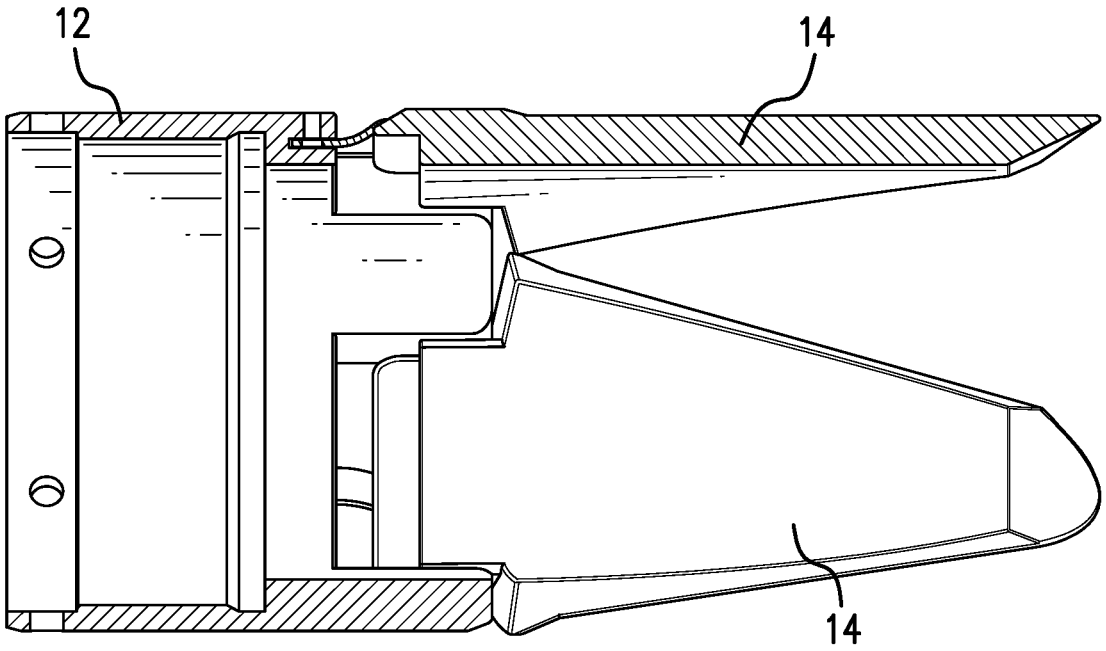
FIGS. 11 and 12 illustrate cross section views of the tool of FIG. 7.
Figure 12:
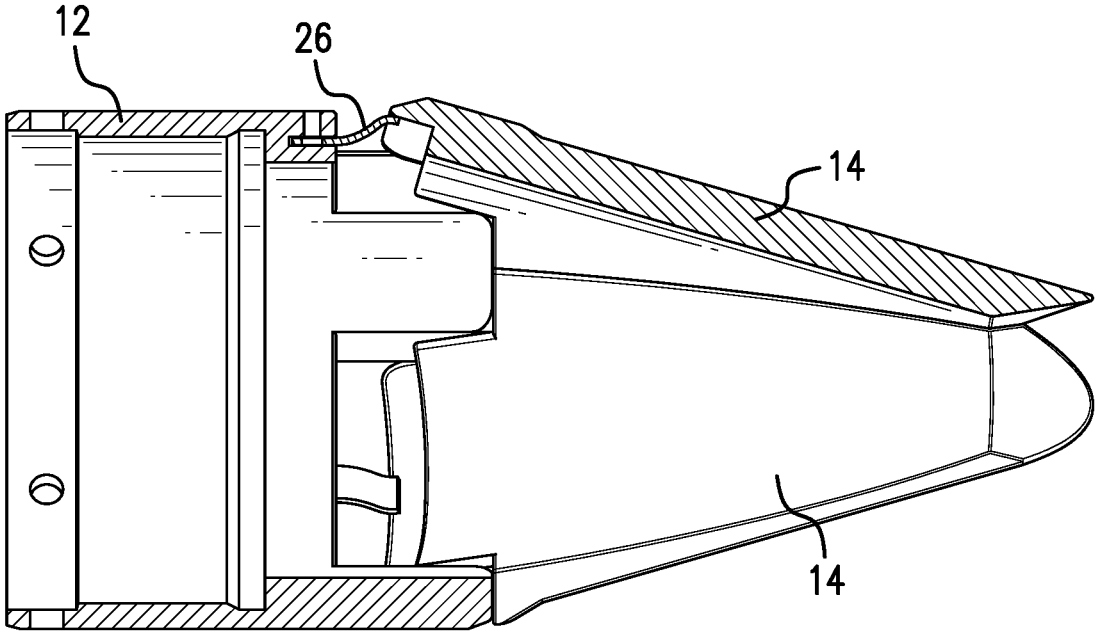
Figure 13:
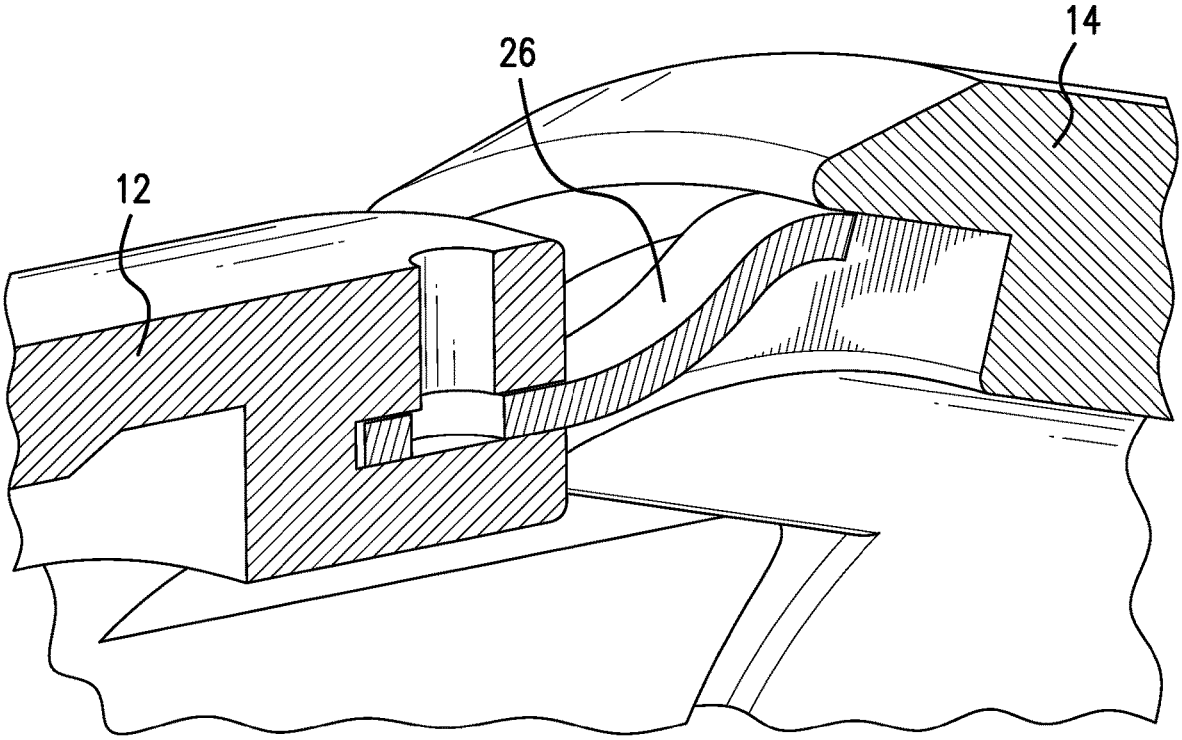
FIGS. 13-14 illustrate enlarged views of portions of tools shown in FIGS. 1-12.
Figure 14:
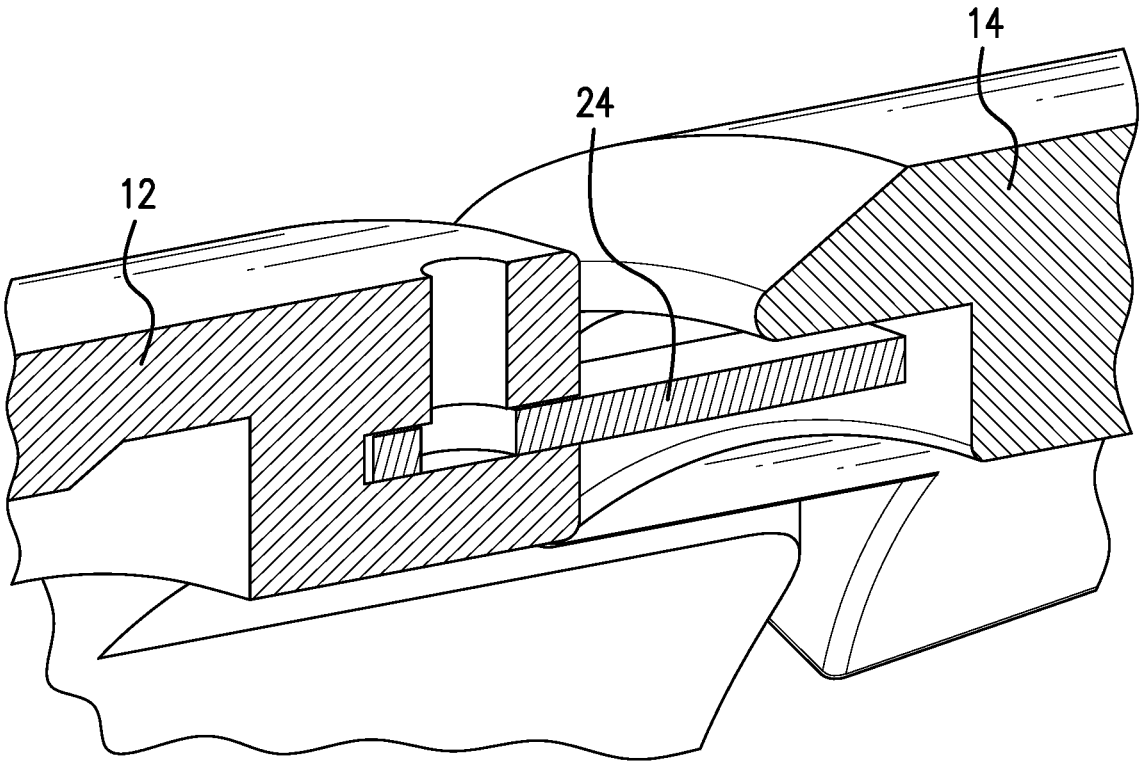

Tapered nose tool 10 comprises a housing 12 having a tubular shape that in some cases will be cylindrical as illustrated. Attached pivotally to the housing 12 are a plurality of doors 14. Each of the plurality of doors is shaped and arranged such that a tapered form is created when the plurality of doors 14 are brought together as shown in FIG. 1, 3 or 5, for example. Illustrated is a three-door configuration but other numbers of doors are contemplated such as 2, 4, 5, etc. The doors in this embodiment include a closed nose configuration 16, wherein each door 14 includes a portion of the nose configuration 16 that comes together to create the complete closed nose. Assisting to hold the doors 14 closed in some embodiments are hold members 18 disposed in the area of the closed nose configuration 16 as illustrated in FIG. 2. In embodiments the hold members may be magnetic and may be permanent magnets. These are optional but may be helpful in some situations. Also, (or only) holding the doors 14 closed are biasing members 20. These are visible in FIG. 2 and can be seen in more detail in FIGS. 5, 6, and 11-15. While other specific configurations for biasing the doors 14 to the closed position are also contemplated, such as torsion springs 15 disposed about pivot points 21 between doors and body (visible in FIGS. 15A (closed) and 15B (open); tension springs 17 visible in FIGS. 15C (closed) and 15D (open), a piston arrangement to bias the doors, a compression spring disposed between faces of the doors and body, etc. Another optional feature that should be appreciated from FIGS. 15A, 15B and 15E are a foot surface 23 of the doors 14 and a stop surface 25 of the doors 14. The foot surface is angled and dimensioned to mate with an end surface 29 of the tubular to which the doors 14 are mounted so that each door 14 even if urged to the closed position without the other doors 14 will not rotate about its pivot more than it is supposed to. Rather surface 29 and foot surface 23 will make contact at that degree of pivot. Further, each of the stops 25 are configured and positioned to interact with an adjacent stop 25 to prevent the doors 14 from opening more than they are supposed to do. Adjacent surfaces 25 will make contact as the maximum designed opening is reached. Another configuration for biasing the doors 14 is illustrated in FIG. 15F, wherein alternate tension springs 17*a* are mounted to extend through a greater longitudinal portion of the doors 14. One end of spring 17*a* is mounted to door 14 at connection 31 and the other end is mounted to housing 12 at connection 33. It will be appreciated that the spring 17*a* is located radially inwardly of pivot 21 and hence will tend to move the doors 14 to a closed position. Since the pivot 21 is close to the position of the spring 17*a*, one embodiment will include a buttress 29 to prevent the spring 17*a* from moving over-center of the pivot 21 and acting to open rather than close the door 14. In yet another configuration for biasing the doors 14 to a closed position, referring to FIG. 15G, one or more cone springs 35 (also known as spring washers) are disposed between the doors 14 and the housing 12. This configuration includes a link 37 pivotally connected to door 14 at pivot 39 and to a ring 41 at pivot 43. The link 37 translated opening movement of the door 14 to axial displacement of pivot 43, which in turn causes the ring 41 to compress the cone spring 35. Resilience of the cone spring 35 tends to close the door 14.

The FIGS. 5, 6 and 11-15 illustrate two of the embodiments wherein the biasing members 20 are a flat plate 24 spring member or a curved plate 26 spring member (leaf spring). The spring members 24 or 26 are positioned so as to be close to resting position (but still deflected to produce a force) when the doors 14 are closed and further from resting (i.e. more deflected) when the doors are at an open position. This can be seen in the Figures. Due to the greater deflection of spring members 24 or 26 with the doors in the open position, the tool 10 is biased toward the closed position at all times. During use, the tool can be opened through an input (such as reaching a narrower portion of tubular discussed hereunder) and will automatically close upon removal of the input. Hence, this also means the tool may be cycled between positions multiple times during a single run or over individual runs as the interests of the operator require.

Referring to FIG. 3, it will be apparent that each door 14 includes an opening member 22 that if contacted by a portion of a casing or tubing in which the tool 10 is run will put a load on the opening members 22. A load on members 22 is an example of the input addressed above. The load on members 22 causes the doors 14 to rotate about their individual pivot points 21 with housing 12. Sufficient input results in opening of the doors 14 to place the tool 10 in its open position.

Figure 15:
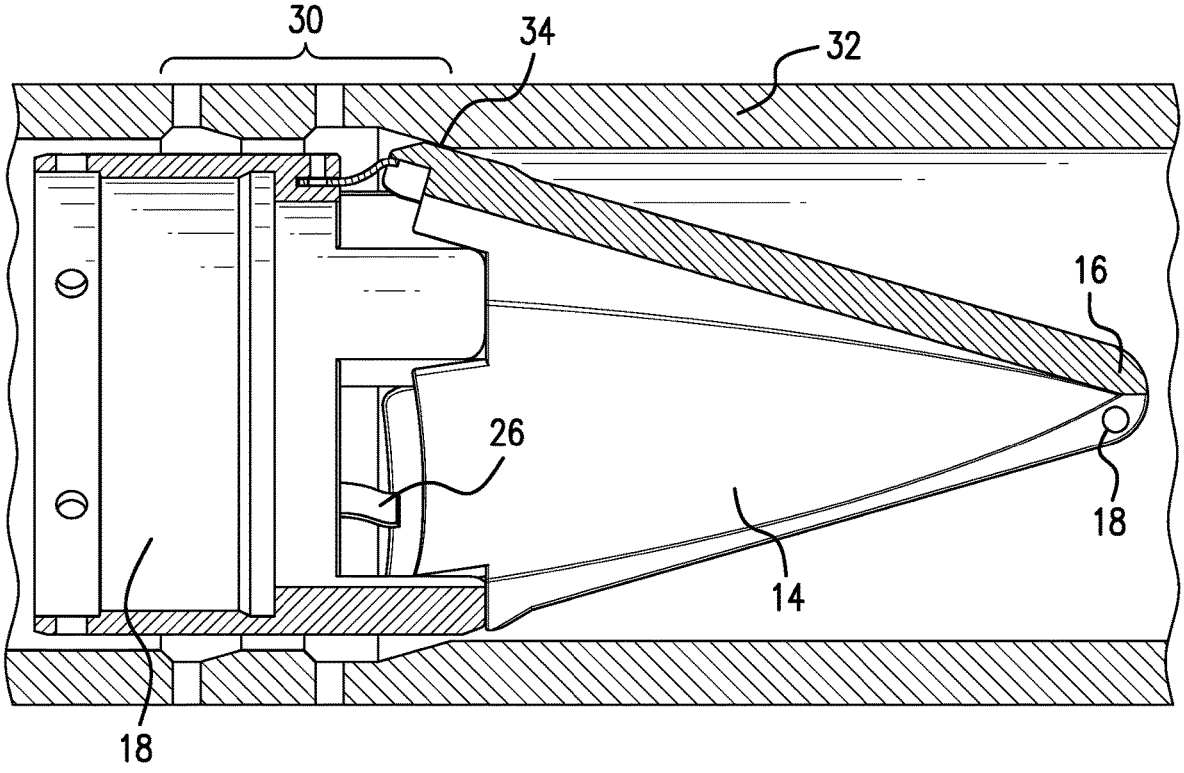
FIG. 15 is another view of an embodiment hereof.
Figure 15A:
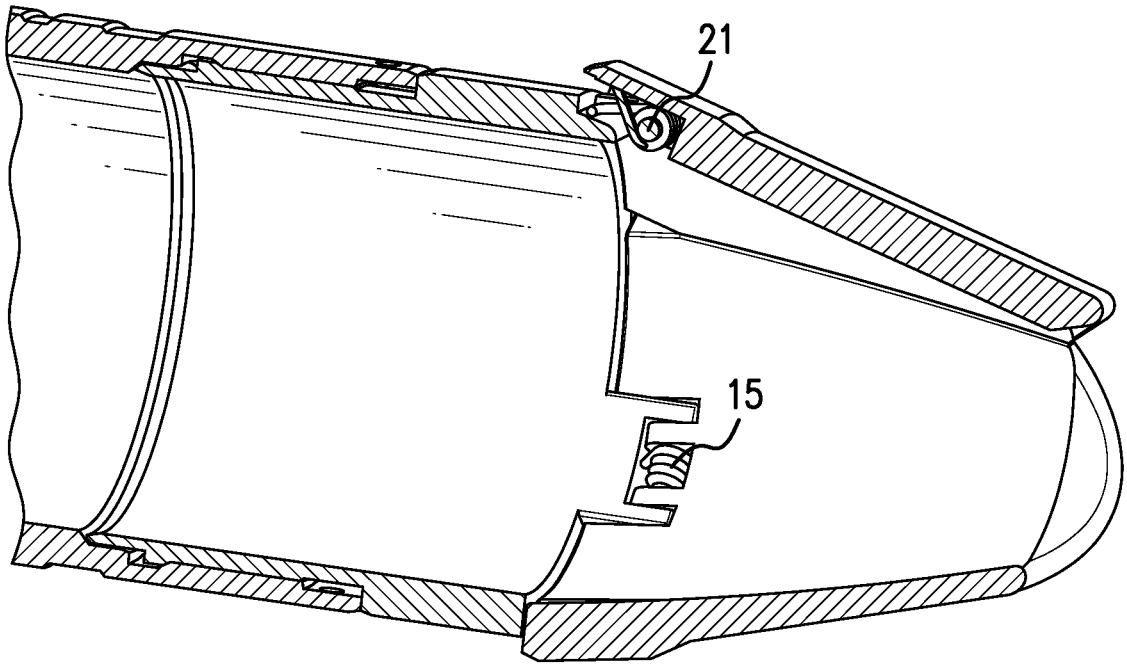
FIGS. 15A-15G illustrate various biasing members for the tool of FIG. 1.
Figure 15B:
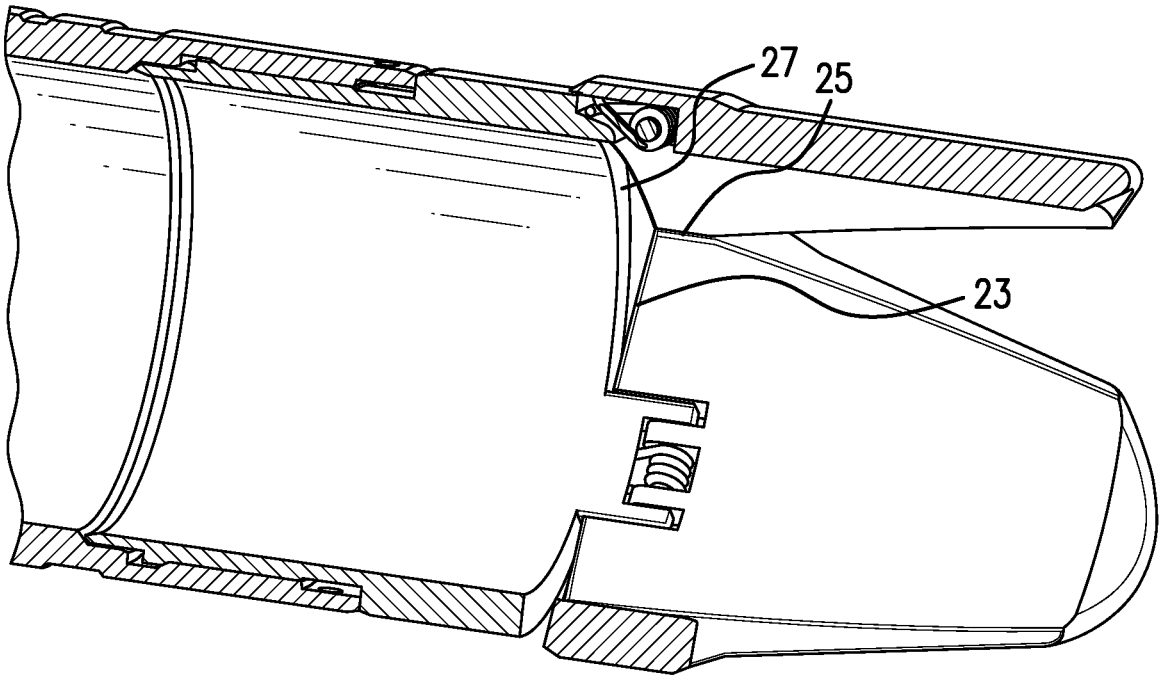
Figure 15C:
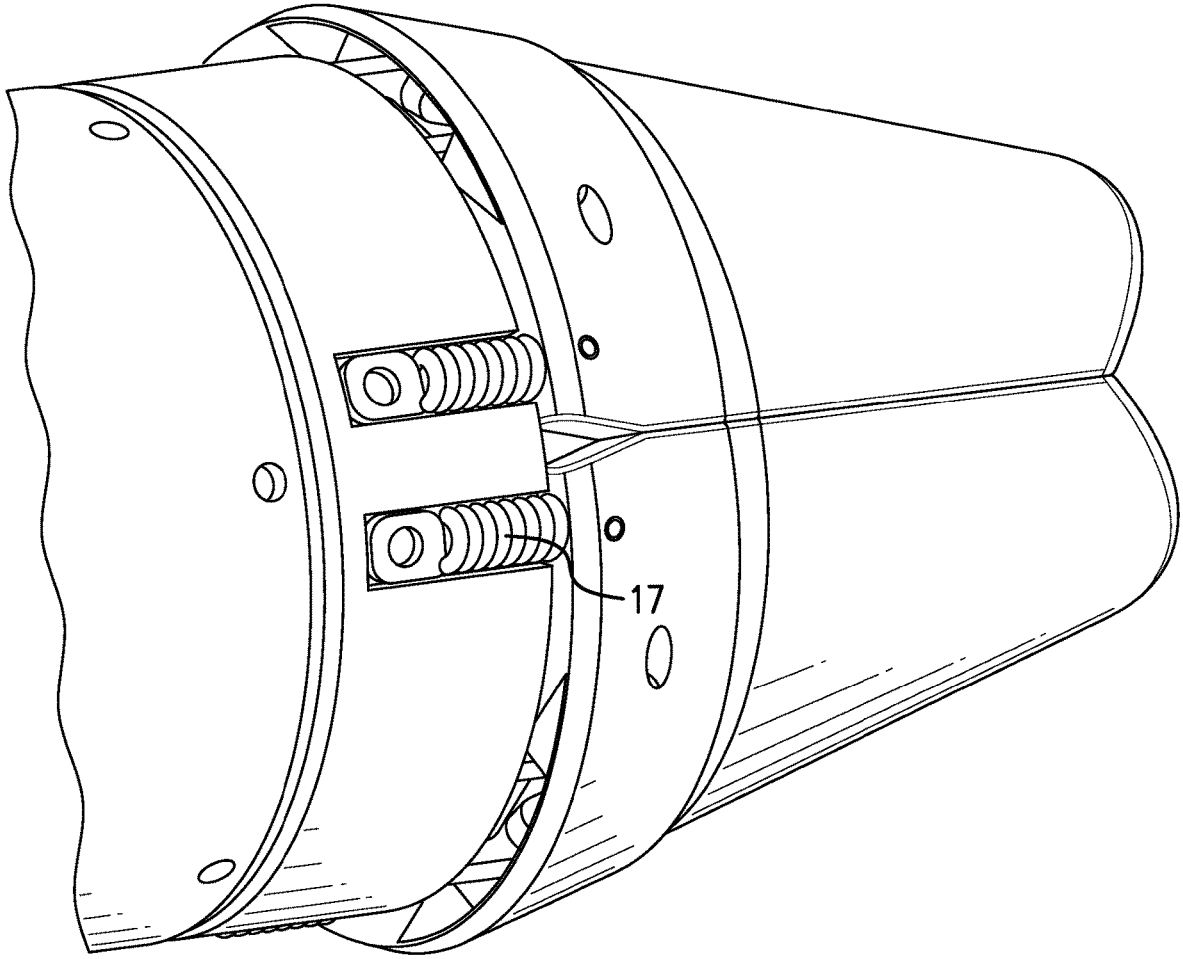
Figure 15D:
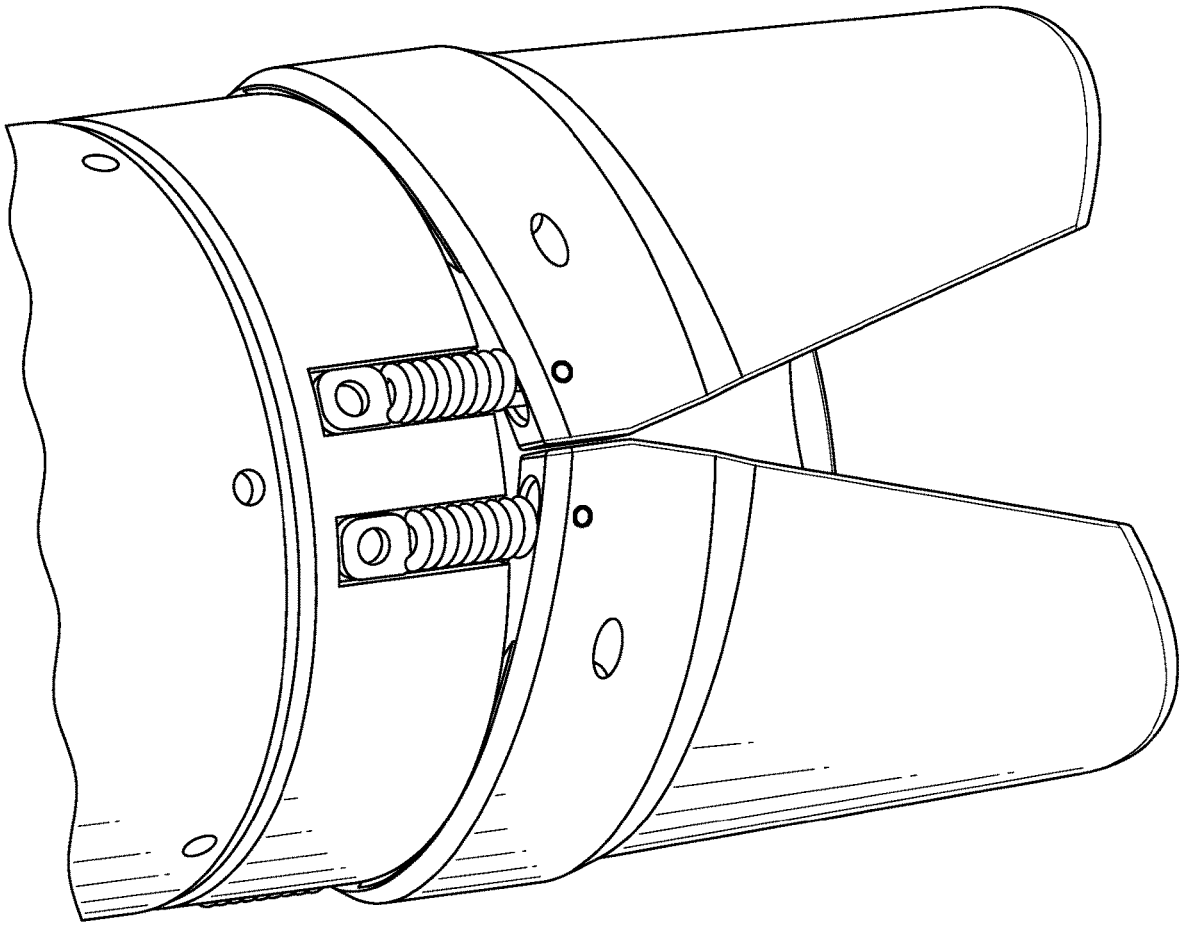
Figure 15E:
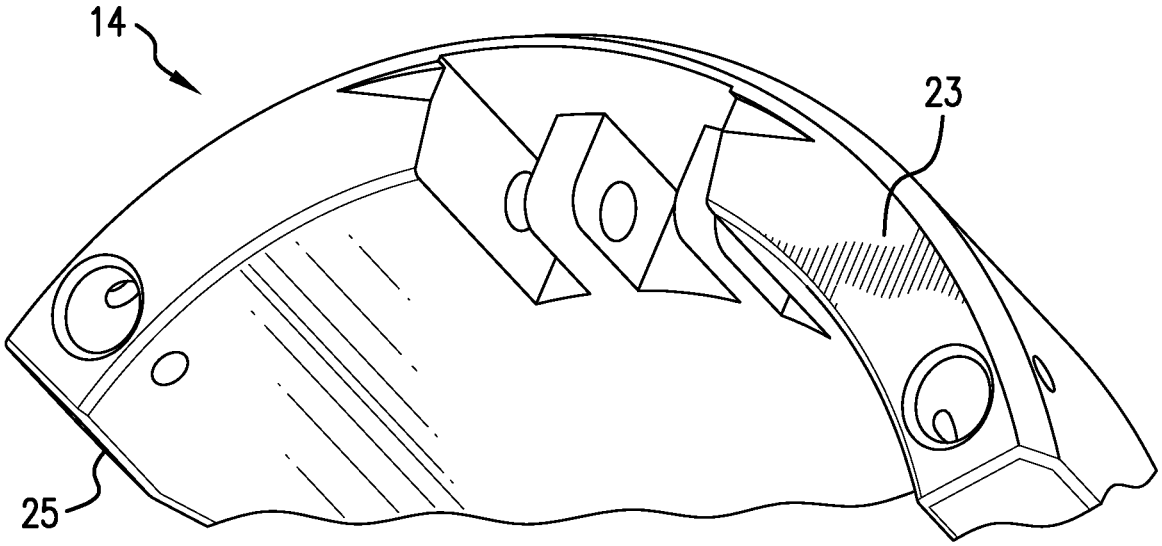
Figure 15F:
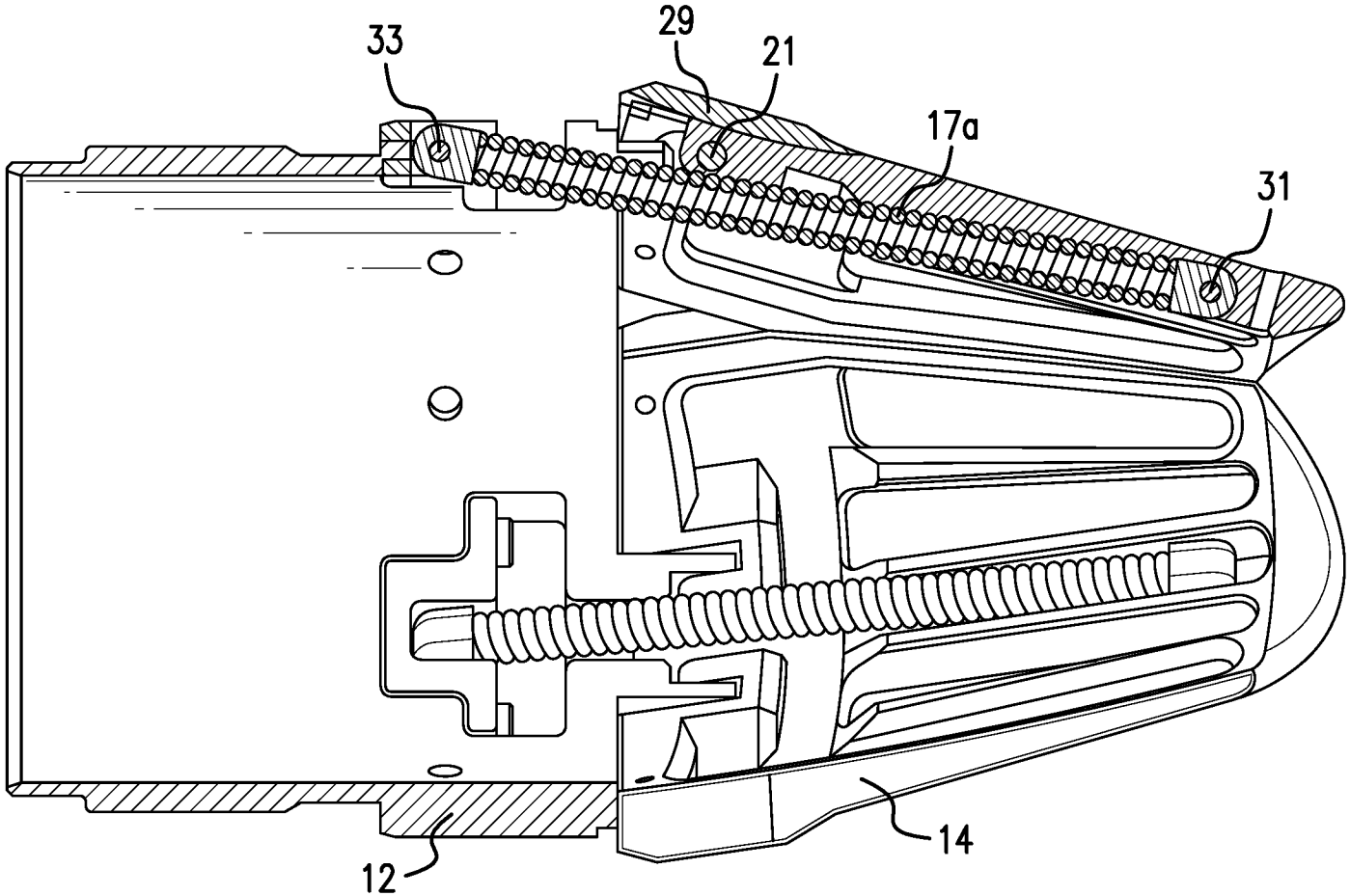
Figure 15G:
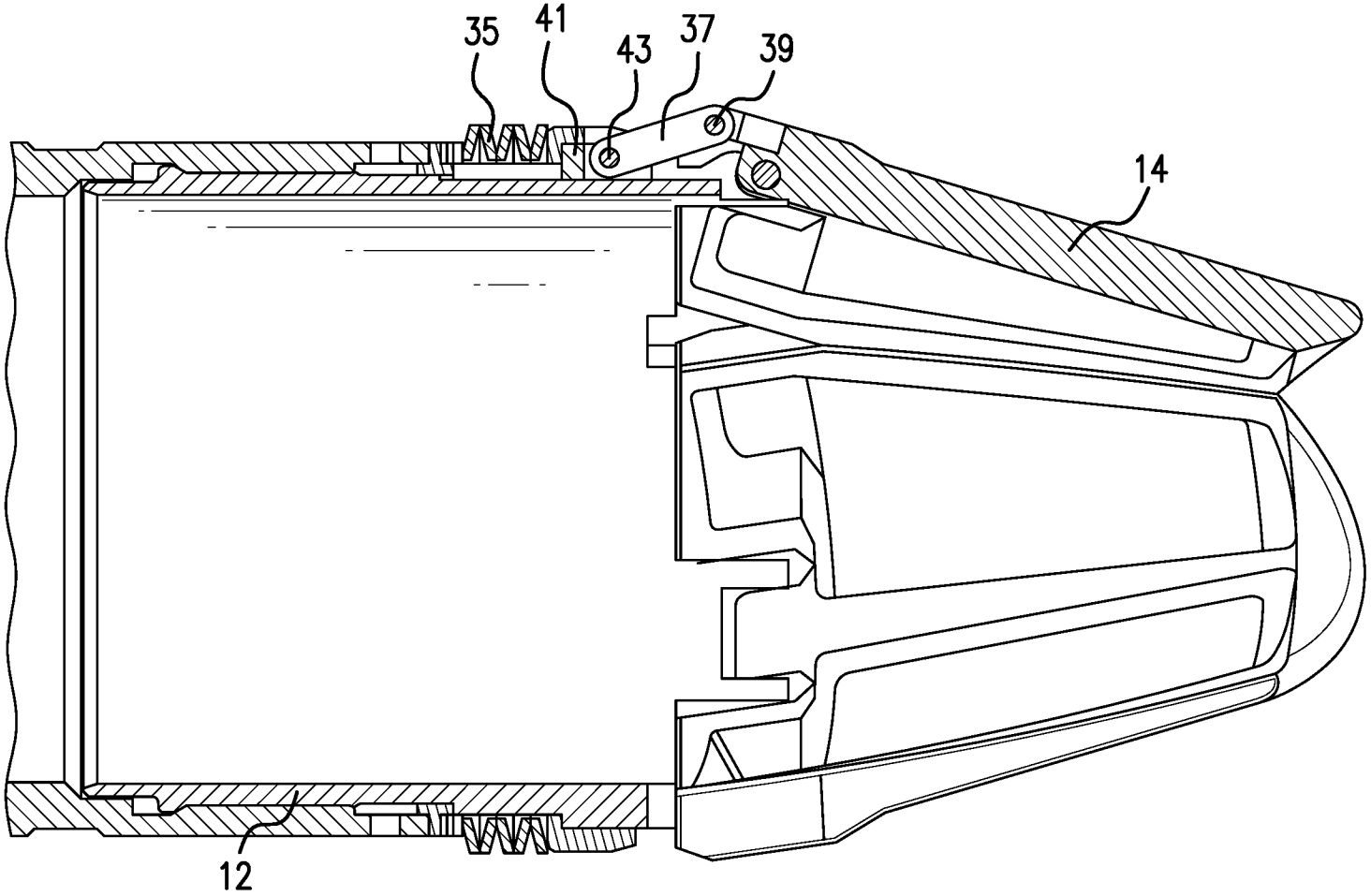
Figure 16:
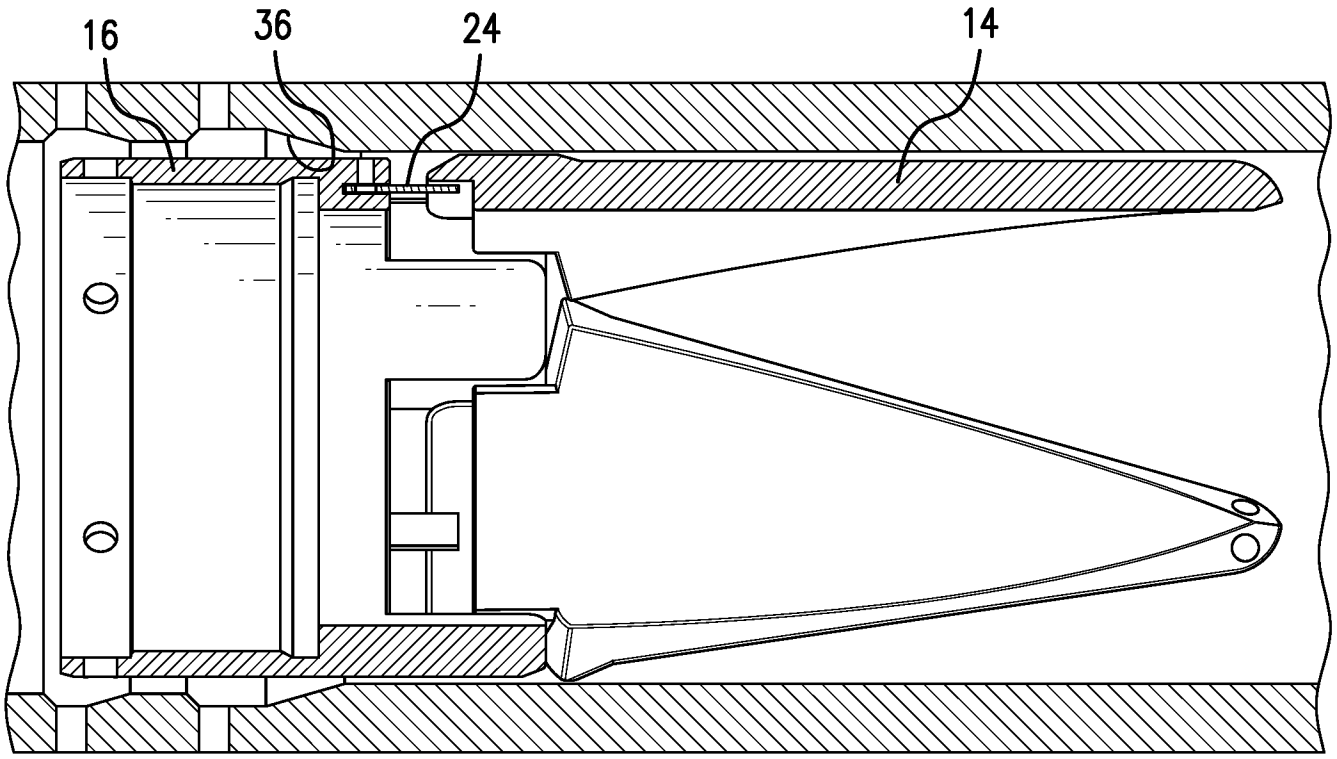
FIGS. 16-17 illustrate the operation of the tool in FIG. 1.
Figure 17:
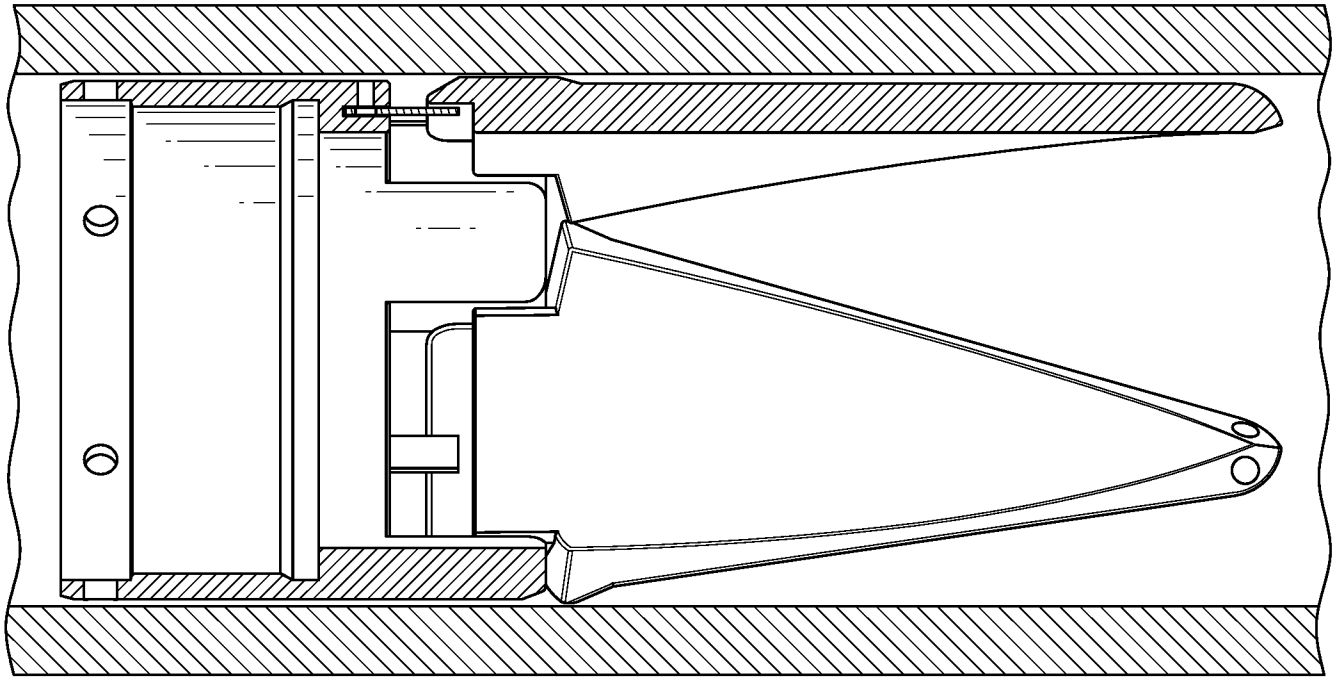

Referring to FIGS. 15-17, the running and opening sequence is illustrated. It will be appreciated that in FIG. 15, the tool 10 slides easily (remaining closed) through a profile 30 area of a casing 32 that otherwise could hang up a blunted string but at a downhole end of that profile 30 where the casing includes a neck down 36, the doors 14 will begin to open. This can be seen in FIGS. 15 and 16 as a sequence considering the contact area 34 that contacts opening member 22 of doors 14. While the tool 10 remains in a section of the casing 32 that is of the smaller diameter referred to above that causes the doors 14 to open, the doors will stay open. When the tool 10 is moved to a position within the casing 32 that has an inside diameter larger than the neck down area referred to, the tool 10 will automatically close doors 14 under the bias of biasing members 20 that may be, as illustrated, spring members 24, 26.

In a very similar embodiment, referring to FIGS. 7-12, a flow port 40 is formed at the ends of doors 14 instead of the closed nose configuration 16. This embodiment allows for fluid flow through the tool 10 while running, if desired and a reduced impediment to tools traveling in the uphole direction. In other respects, the tool illustrated in FIGS. 7-12 is explained by reference to the foregoing with minor changes being clear to one of ordinary skill in the art.

Figure 18:
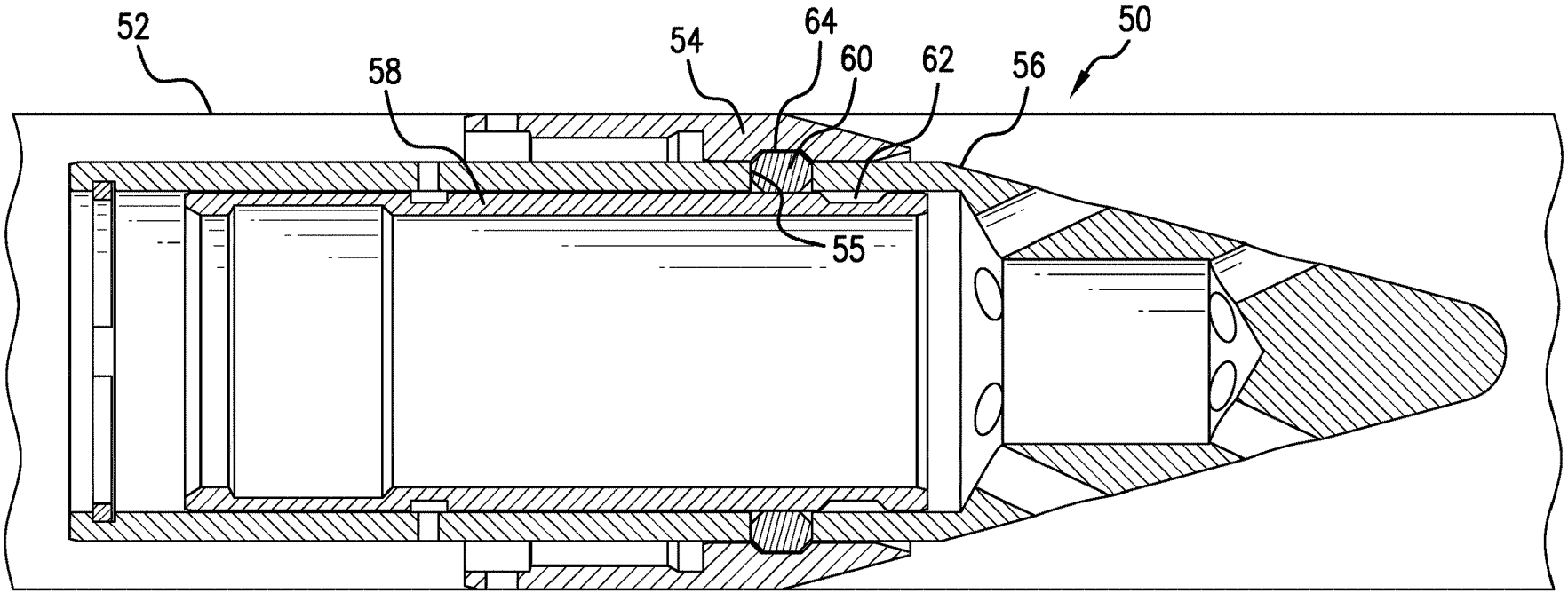
FIG. 18 is cross sectional view of another embodiment of a tapered nose tool in a running condition.
Figure 19:
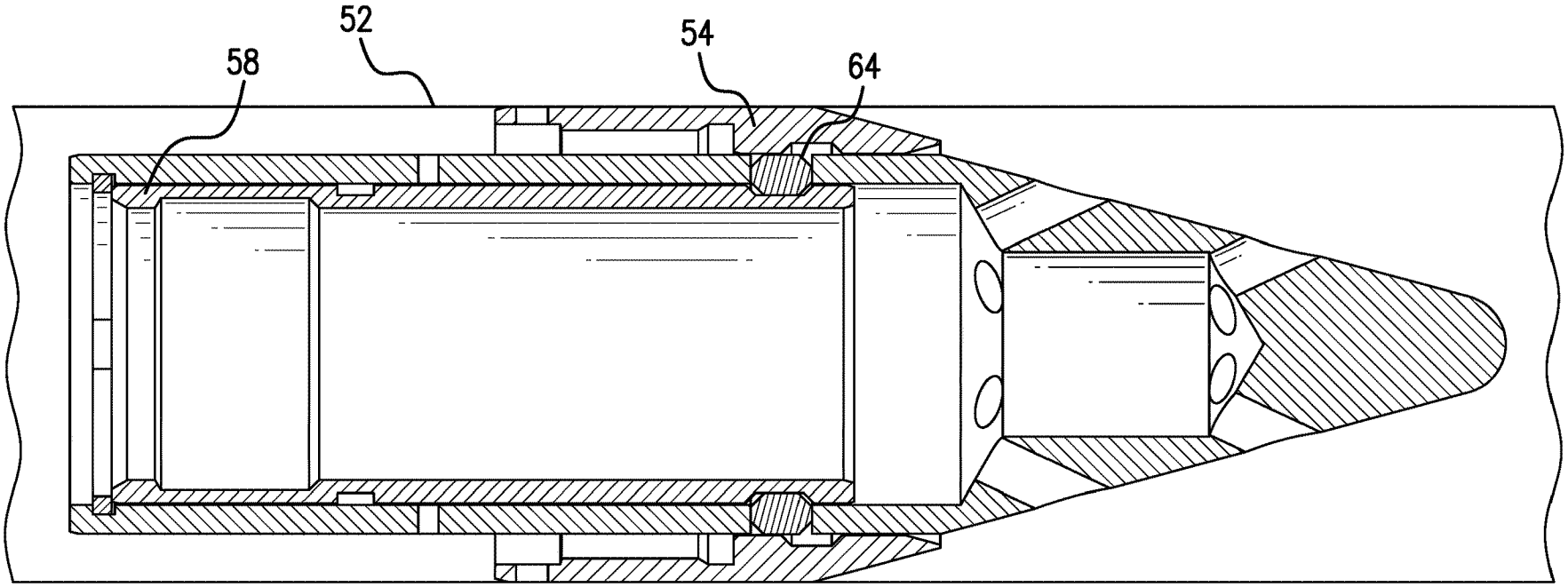
FIG. 19 is a cross sectional view of the tool shown in FIG. 18 in a partially retrieved position.
Figure 20:
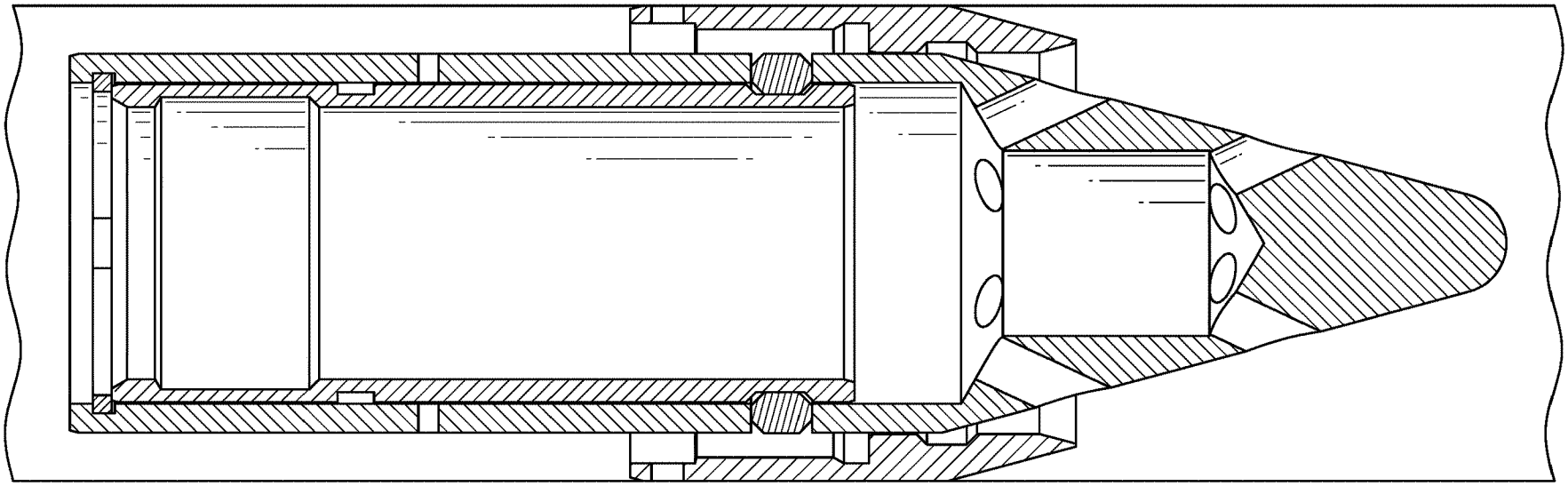
FIG. 20 is a cross sectional view of the tool shown in FIG. 18 in a greater partially retrieved position.
Figure 21:
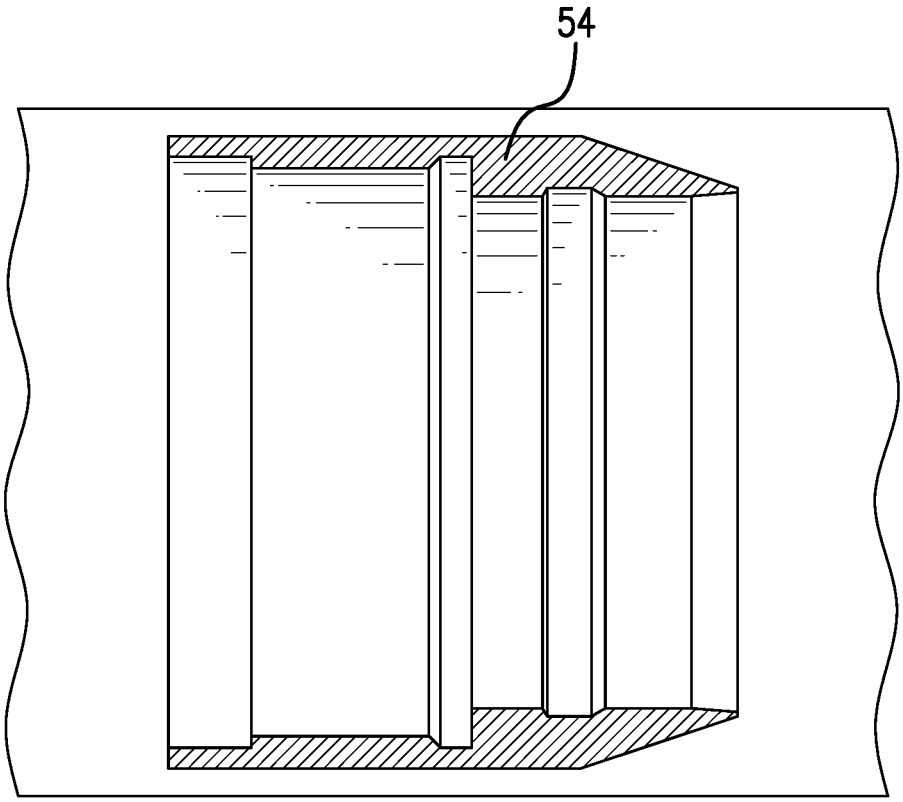
FIG. 21 illustrates the embodiment of FIG. 18 in a fully retrieved position.
Figure 22:
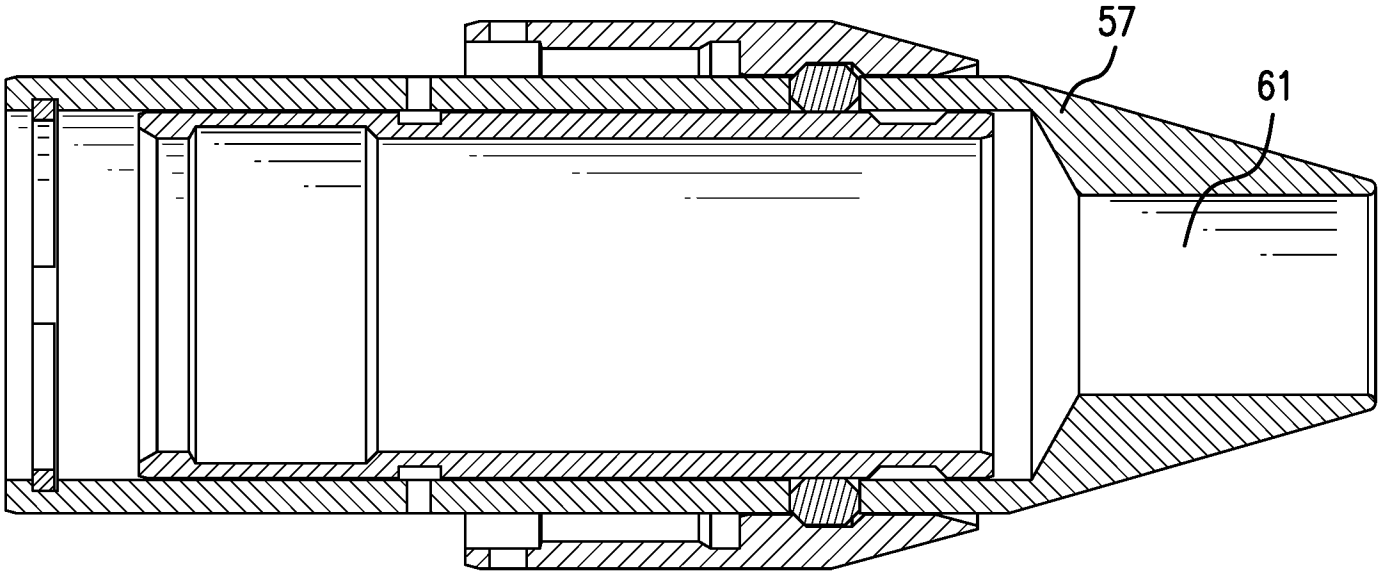
FIG. 22 is an alternate embodiment FIG. 21 but with a through hole added.
Figure 22A:
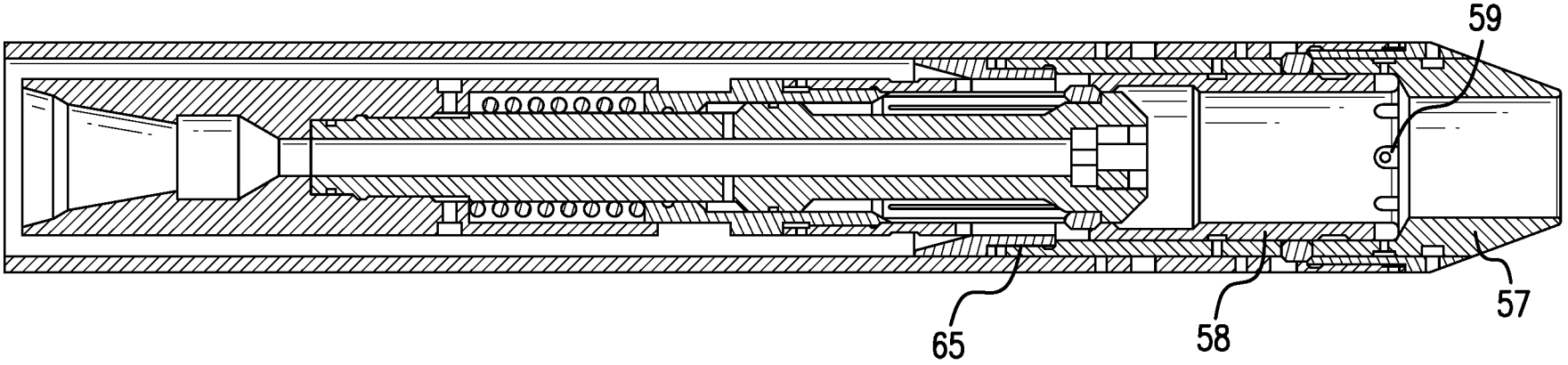
FIG. 22A is another alternate embodiment.
Figure 23:
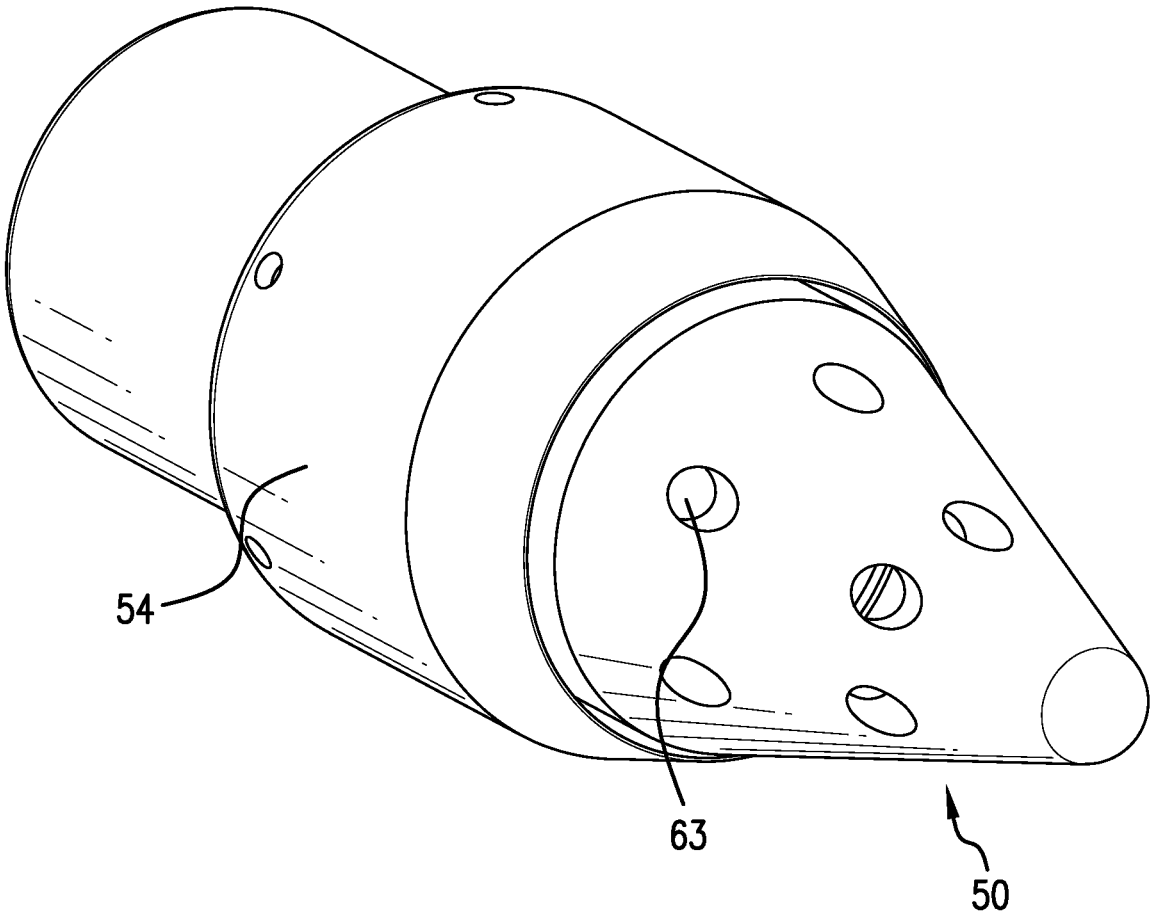
FIG. 23 is a perspective view of the tool of FIG. 18 in the running position.
Figure 24:
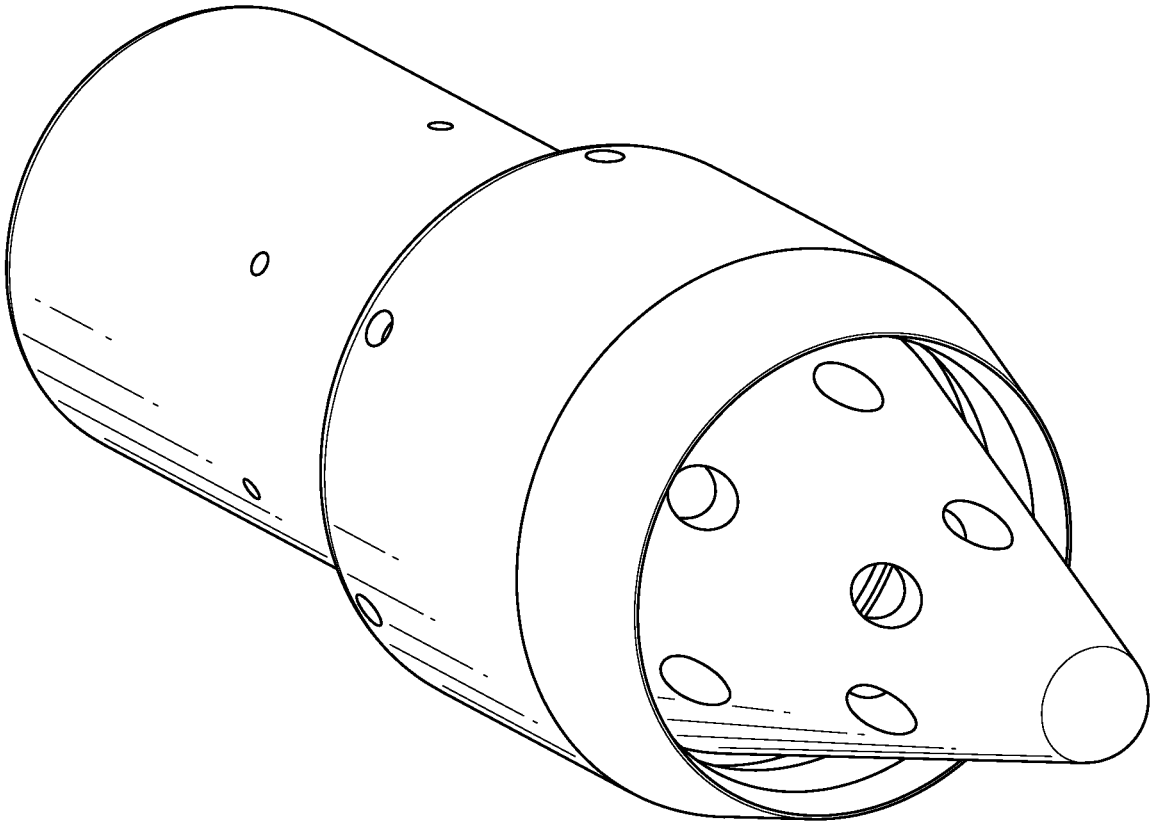
FIG. 24 is the tool of FIG. 18 in a partially retrieved position.
Figure 25:
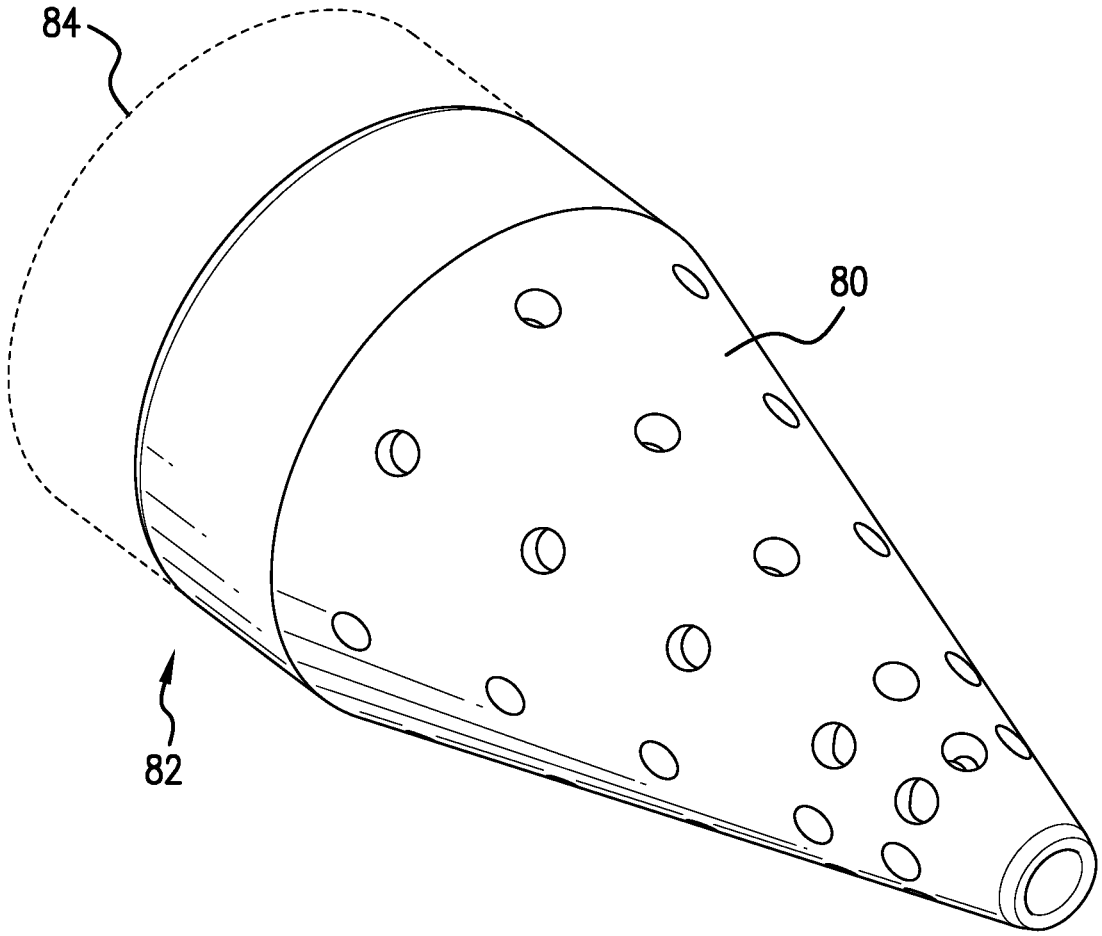
FIG. 25 is a perspective view of another alternate embodiment wherein the nose is degradable illustrating a hole pattern to increase rate of degradation.
Figure 26:
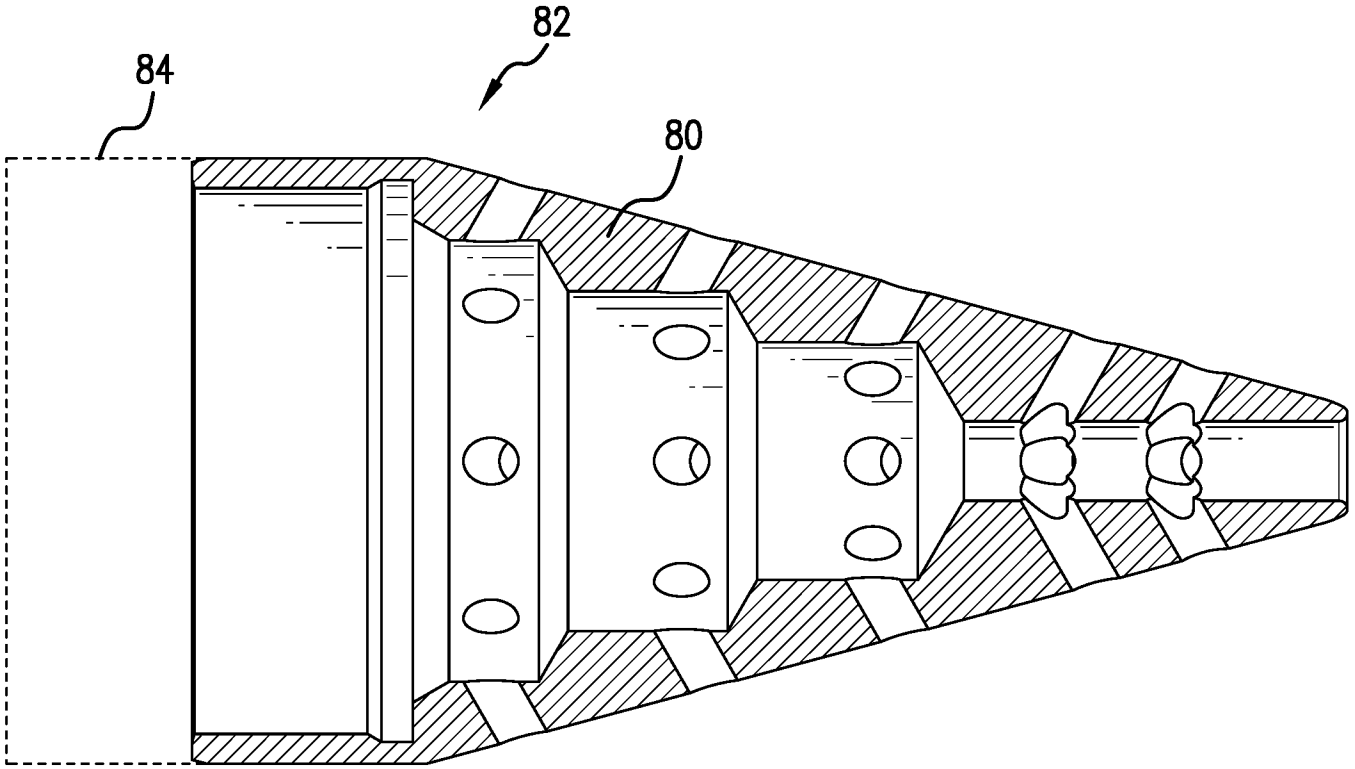
FIG. 26 is a cross sectional view of FIG. 25.
Figure 27:
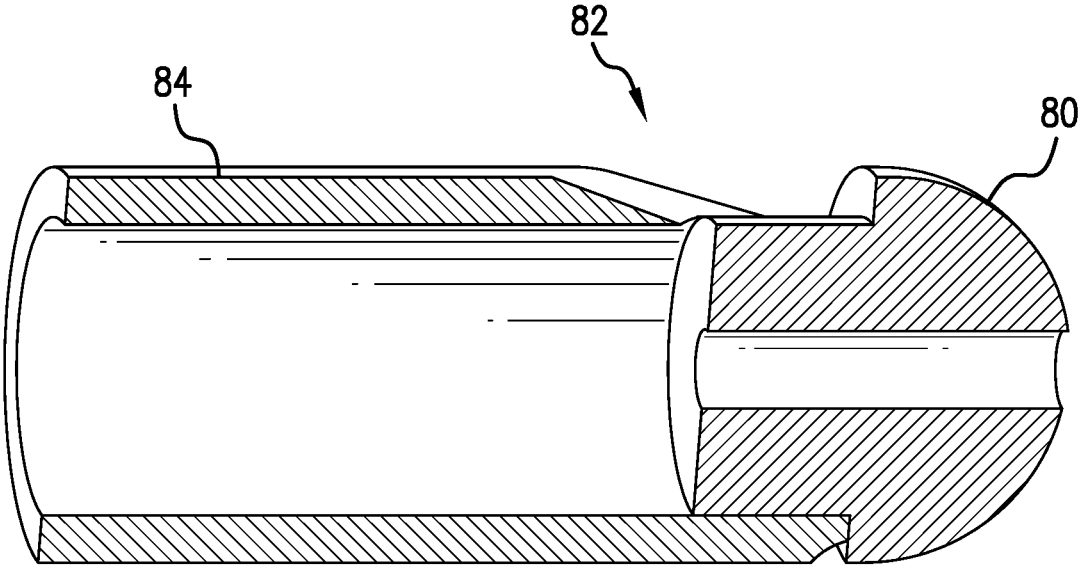
FIGS. 27 and 28 are alternate geometries for other degradable embodiments.
Figure 28:
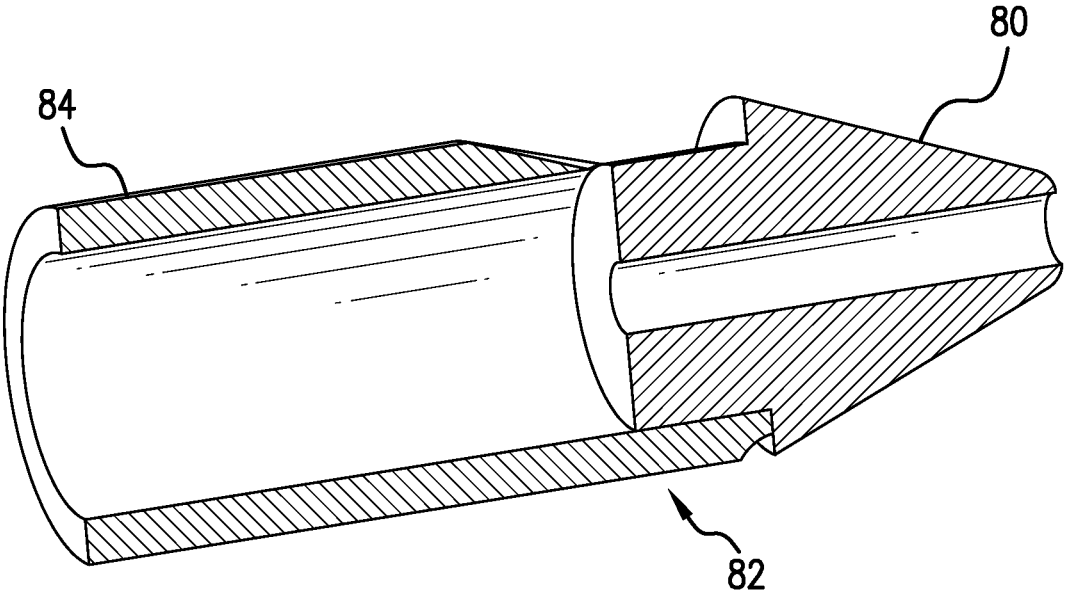

In another embodiment of a tapered nose tool as disclosed herein and referring to FIGS. 18-24 a retrievable tapered nose tool 50 is illustrated. The tool 50 is illustrated within a tubular or seal bore 52. The tool 50 includes a housing 54 disposed around a tapered body or nose 56 and a shifting sleeve 58 disposed within the tapered body 56. In FIG. 18, the tool 50 is illustrated in the running position wherein the tapered body 56 is secured to the housing 54 via a securement 60 such as dogs, a C-ring, etc. passing radially through a securement opening 55 in the nose 56. The shifting sleeve 58 maintains the securement 60 in place. In this position, the tool 50 acts as would any traditional guide shoe tool. When it is desired to remove the impediment that the tapered nose tool presents to through-tubing operations however, portions of the tool 50 are retrievable by moving shifting sleeve 58 to position recess 62 radially inwardly of the securement 60 such that the securement 60 can move out of locking groove 64 in housing 54. This position is illustrated in FIG. 19. With the securement 60 out of engagement with the locking groove 64, the body 56 and the shifting sleeve 58 as well as the securement 60 may be removed from the housing 54. Progress in the described movement is illustrated in FIG. 20. Ultimately, the entirety of the body 56 and the shifting sleeve 58 as well as the securement 60 will be removed from the housing 54, leaving the housing 54 in place in the seal bore 52 and open at the inside diameter thereof for through tubing operations. This condition is illustrated in FIG. 21. FIG. 22 is an alternate embodiment showing a central hole 61 in the tapered body 57 allowing for at least fluids and in some cases other tools to pass through the tapered nose. In a similar embodiment, referring to FIG. 22A, the shifting sleeve 58 is configured with torque lugs or keys 59 that facilitate drill out operations in the event of a failure of retrieval of tapered body 57. An additional feature of the embodiment of FIG. 22A is a threaded connection 65 instead of a snap ring, which may under some circumstances potentially be a hindrance to operations. FIGS. 23 and 24 provide a perspective view of the tool 50 in the running position (FIG. 23) and in a partially retrieved position (FIG. 24), that position being consistent with the position illustrated in FIG. 20. Tool 50 in this embodiment includes flow openings 63 to allow for fluid flow through the tool 50 before the tapered nose is retrieved. It is to be understood that although the FIGS. 18-24 illustrate one variation of this embodiment where the body 56 is axially centrally closed, in another variant, there is a central axial opening in that body to allow for through flow of fluids if desired, similar to hole 61 in FIG. 22.

In yet another embodiment of a tapered nose tool, and referring to FIGS. 25-28, it is contemplated that a tapered nose component 80 of a tapered nose tool 82 be degradable (i.e. dissolvable, disintegrable, etc. essentially meaning that the component goes away over a specified time frame). The illustrated configurations each exhibit outer surfaces that may be useful for certain conditions and further illustrate a number of different opening patterns. The opening patterns are useful for controlling the rate of degradation of a particular degradable material by controlling surface area exposed to downhole fluids or applied fluids. In each case, the diameter left available for further operations is controllable by dictating the diameter of the mounting portion 84 since the tapered component 80 will substantially or completely disappear in some embodiments. The tapered component 80 may be held in place on the mounting portion 84 using press fit, fasteners, adhesives, threaded connection, etc. as desired.

Figure 29:
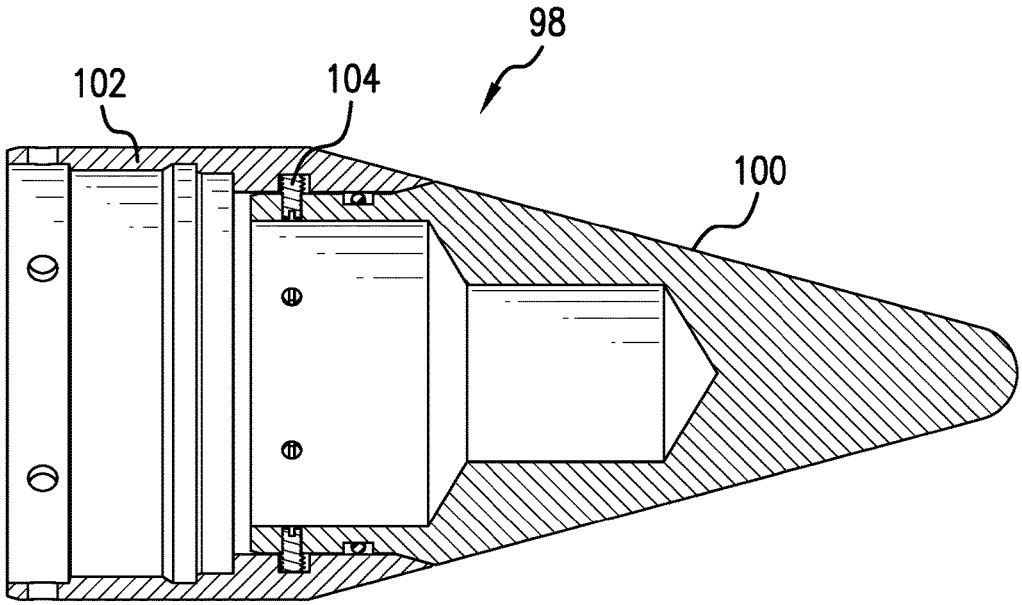
FIG. 29 is a cross sectional view of another alternate tapered nose tool embodiment.
Figure 30:
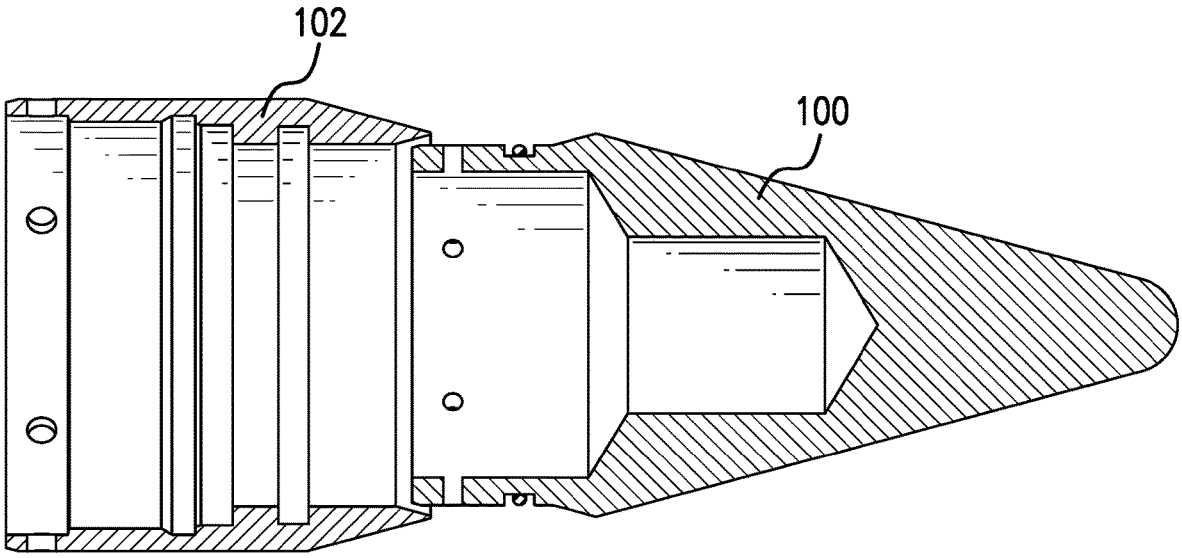
FIG. 30 is a cross sectional view of the embodiment of FIG. 29 with a nose component partially ejected.
Figure 31:
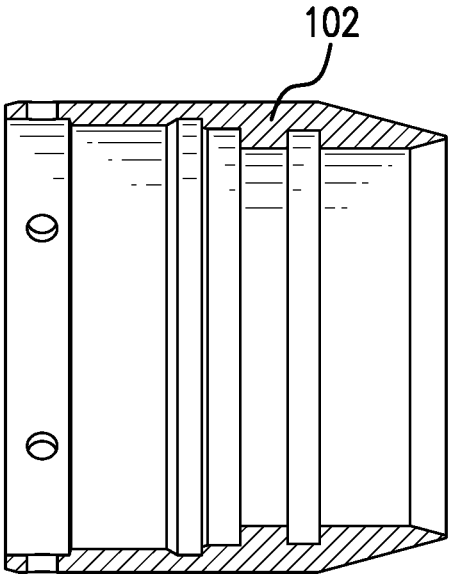
FIG. 31 illustrates the embodiment of FIG. 29 with the nose component fully ejected.

Referring to FIGS. 29-31, yet another tapered nose tool embodiment is illustrated. This embodiment of a tapered nose tool 98 contemplates the removal of a tapered tip 100 from a housing 102 by pressure. The tapered tip 100 is attached to a housing 102 by retention members 104 such as shear screws or similar. Upon running this embodiment in the borehole, the functions of a bull nose tool are realized. When that function is no longer needed, through tubing operations may be initiated after pressuring up on a string connected to the tool 98. At a selected threshold pressure, the retention member(s) 104 will release and the tip 100 will be released from the housing 102. Partial ejection is illustrated in FIG. 30 and complete removal leaving only the housing 102 is illustrated in FIG. 31. In variations of this embodiment, the tip 100 may be degradable or frangible such that upon released from the housing 102, tip 100 or pieces thereof will not be an impediment to other wellbore operations.

Figure 32:
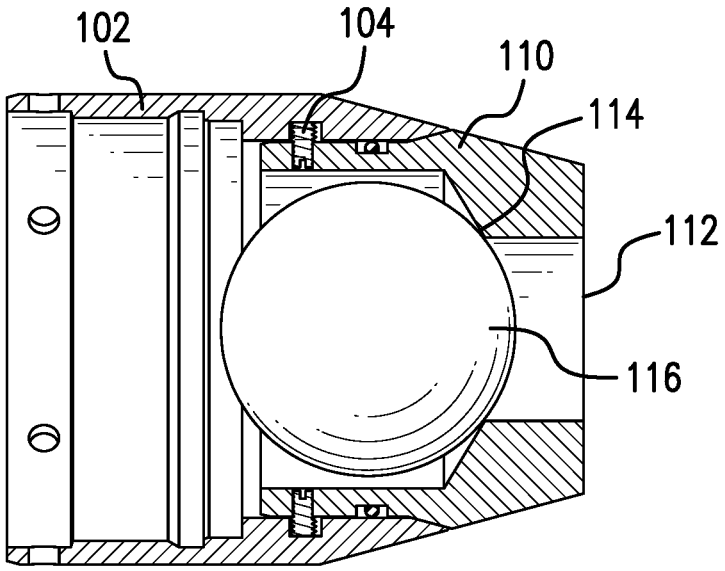
FIGS. 32-34 illustrate a similar concept as FIGS. 29-31.
Figure 33:
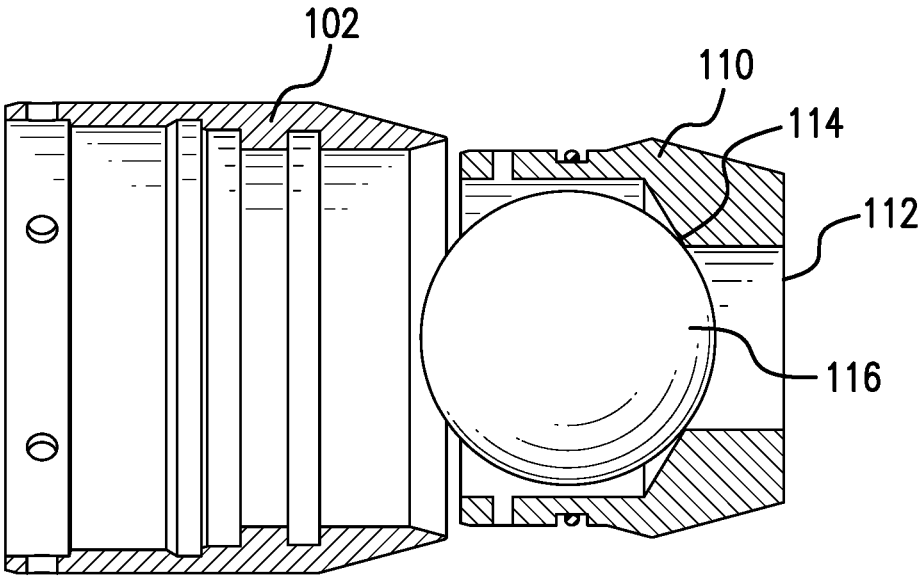
Figure 34:
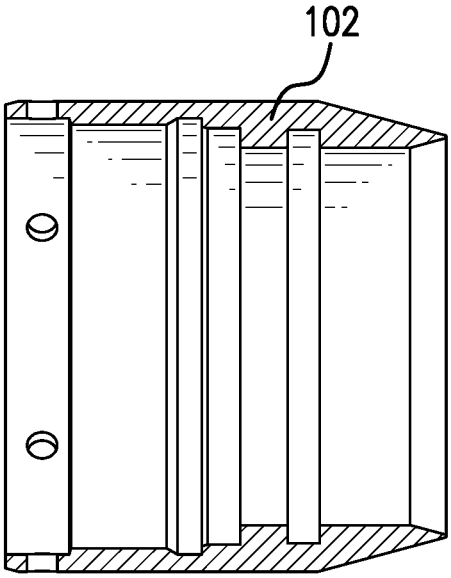

In a similar but distinct embodiment, referring to FIGS. 32-34, a different tapered tip 110 is mounted to housing 102. The mounting is the same as in FIGS. 29-31 but it will be noted that the tapered tip 110 is not closed ended but rather provides a port 112 and a seat 114 for an object 116 that may either be present upon running or flowed to the seat thereafter. as desired. In either case, pressuring as in the embodiment of FIG. 29-31 causes the retention member(s) 104 to release and the tapered tip 110 to be ejected as illustrated in FIG. 33. FIG. 34 similar to FIG. 31 illustrates the housing 102 after ejection of the tapered tip 110 and ready for through tubing operations. Also, as in the above embodiment, it is contemplated that the tapered tip 110 may be frangible or degradable such that upon ejection, the component or pieces thereof will not interfere with other wellbore operations.

Figure 35:
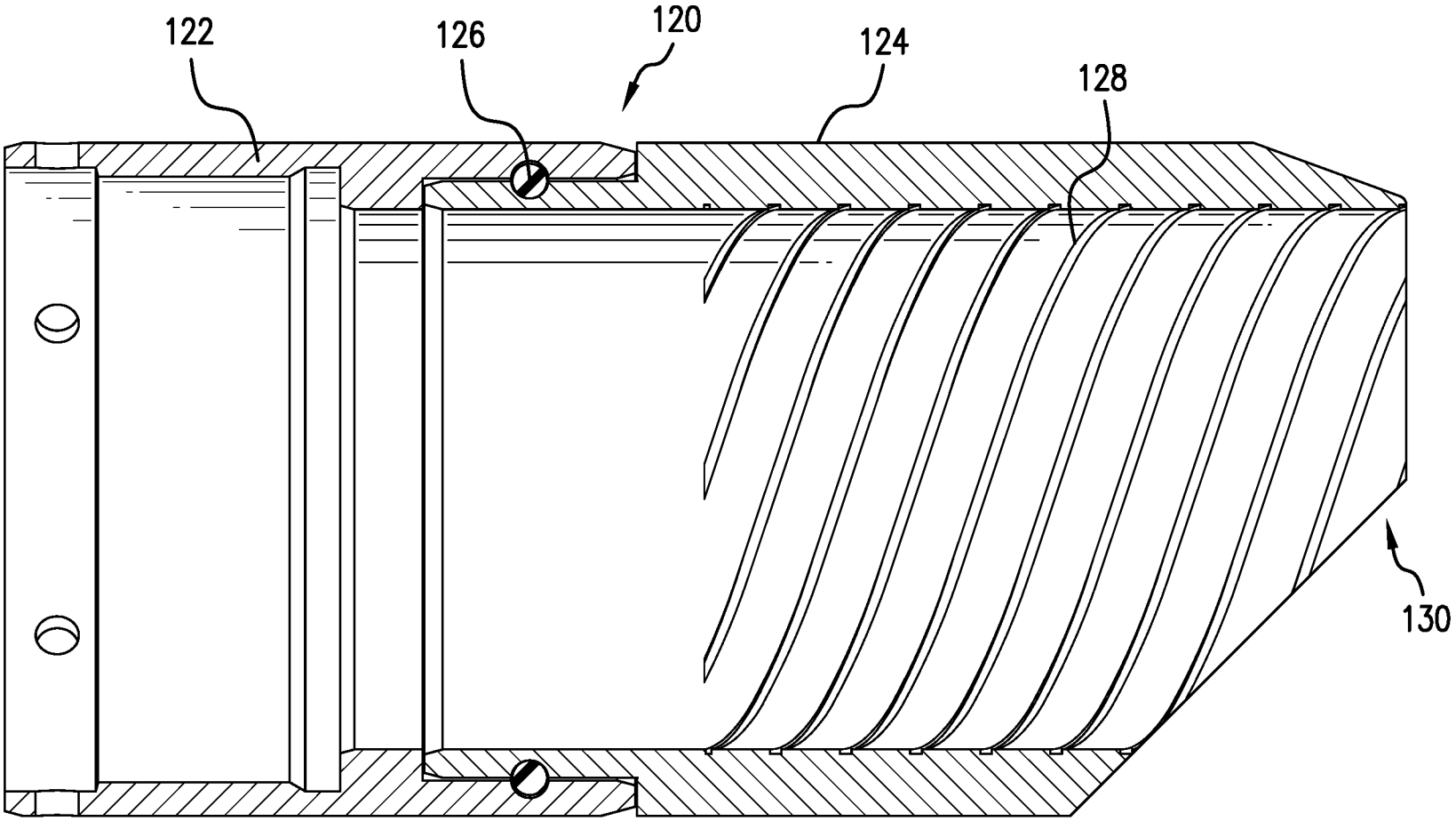
FIG. 35 is a cross section of another embodiment of a tapered nose tool employing fluid driven rotation.
Figure 36:
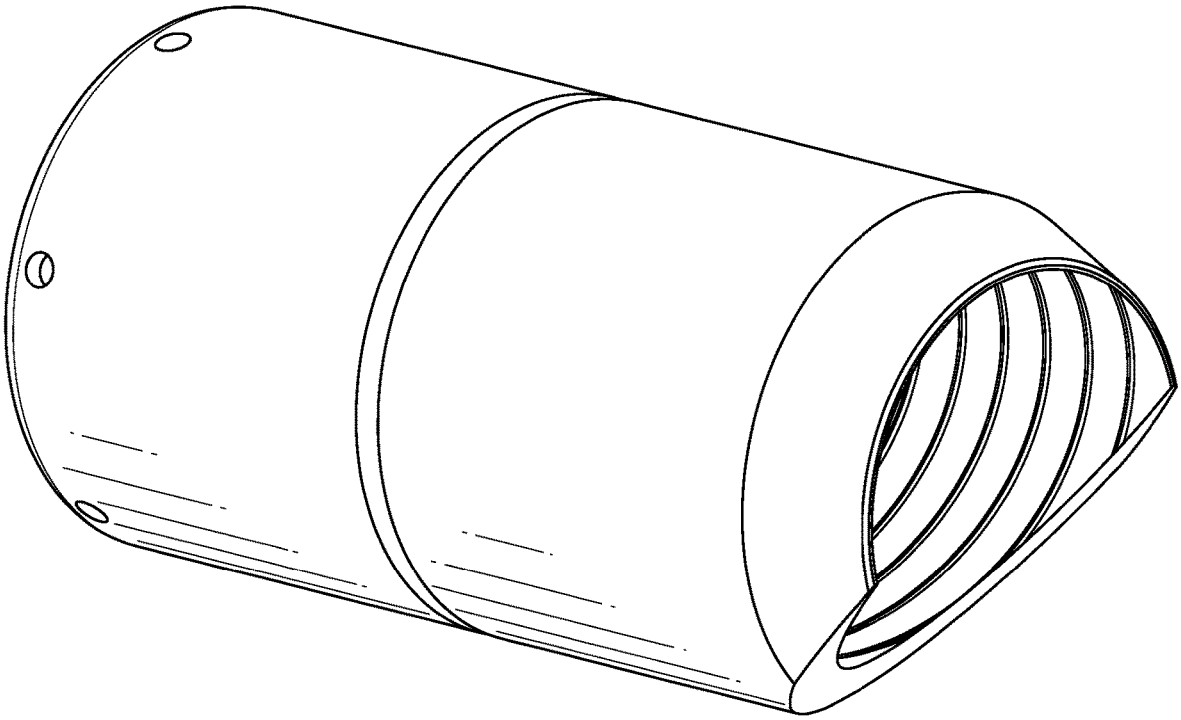
FIG. 36 is a perspective view of the embodiment of FIG. 35.
Figure 37:
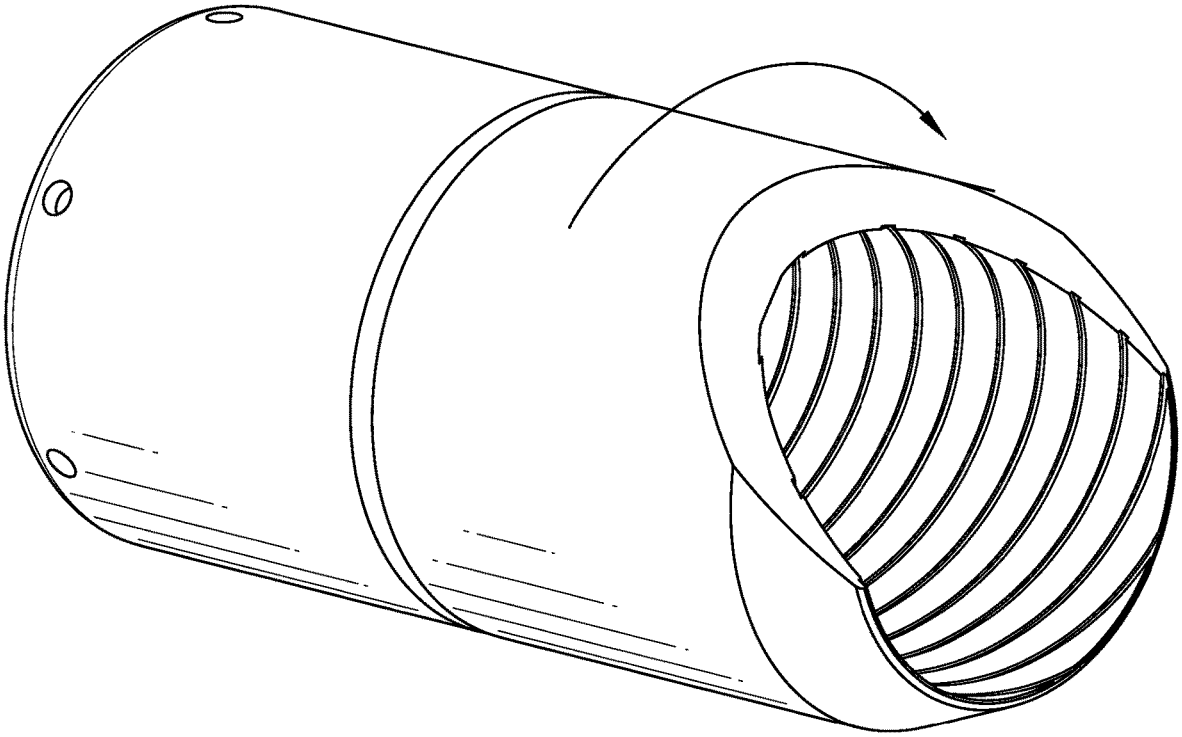
FIG. 37 shows the rotation of the tapered nose component compared to the initial position of FIG. 36.

In yet another embodiment, referring to FIG. 35-37, a tapered nose tool 120 includes a housing 122 and a rotary shoe component 124. The shoe component 124 is mounted to the housing 122 via a bearing 126 allowing the shoe component 124 to spin easily relative to the housing 122. At an inside diameter surface of the shoe component 124 is one or more helical grooves 128 that are interactive with fluid flowing through the shoe component 124. Flowing fluid interacting with the helical grooves will cause the shoe component 124 to spin. It is also to be appreciated that a leading end 130 of the shoe component 124 is asymmetrically cut. This is important for operation of the embodiment. In this case, the functions of the guide nose are achieved regardless of not possessing the long tapered leading portion of traditional Bull nose tools by taking advantage of the asymmetric profile and the rotation of the shoe component 124 together. The shoe component 124 will tend to climb any profile or hang up point due to the combination of the end asymmetry and the rotation thereof. By doing so, the tool will work its way through such points merely by flowing fluid therethrough. In this case, there is no restriction of the ID of the string to which this tapered nose tool 120 is connected. Rather the ID is completely open such that later through-tubing operations will not be hindered.

Figure 38:
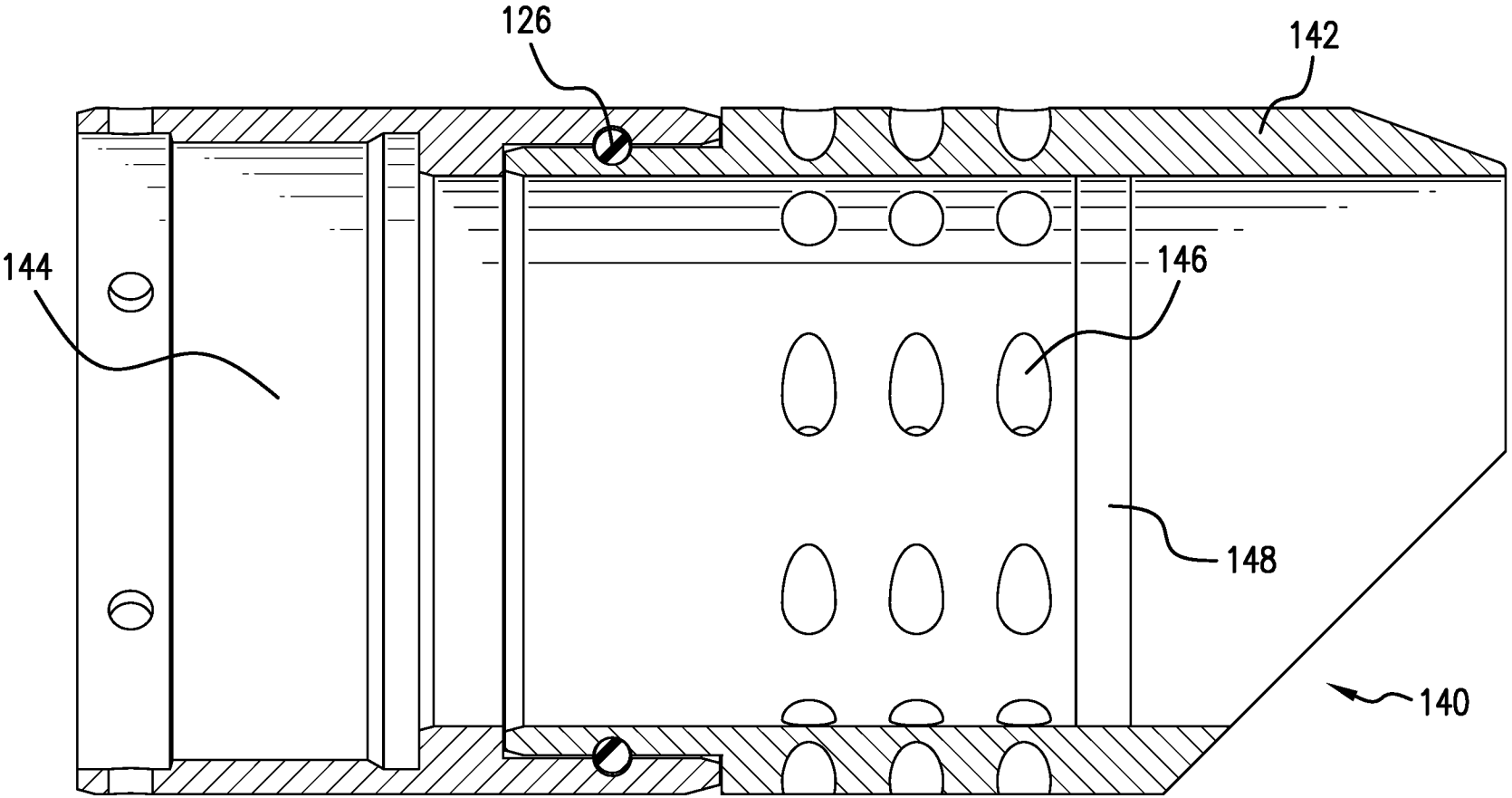
FIG. 38 is a cross sectional view of another embodiment of a tapered nose tool.
Figure 39:
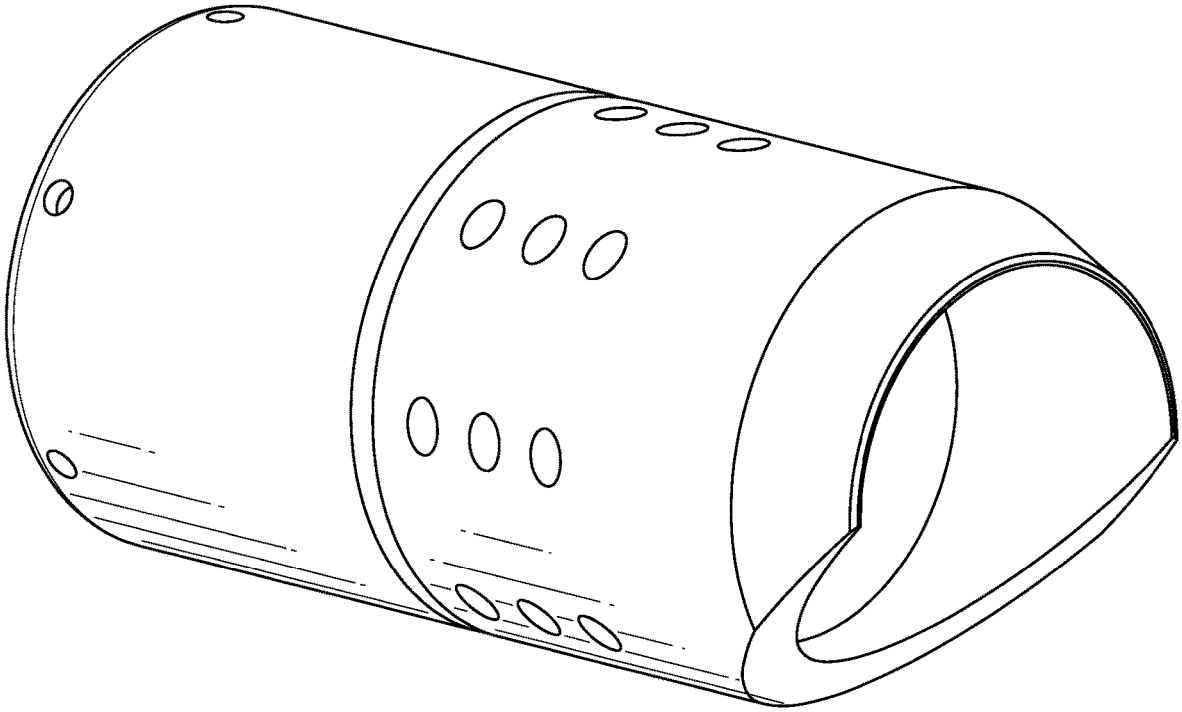
FIG. 39 is a perspective view of the embodiment of FIG. 38.
Figure 40:
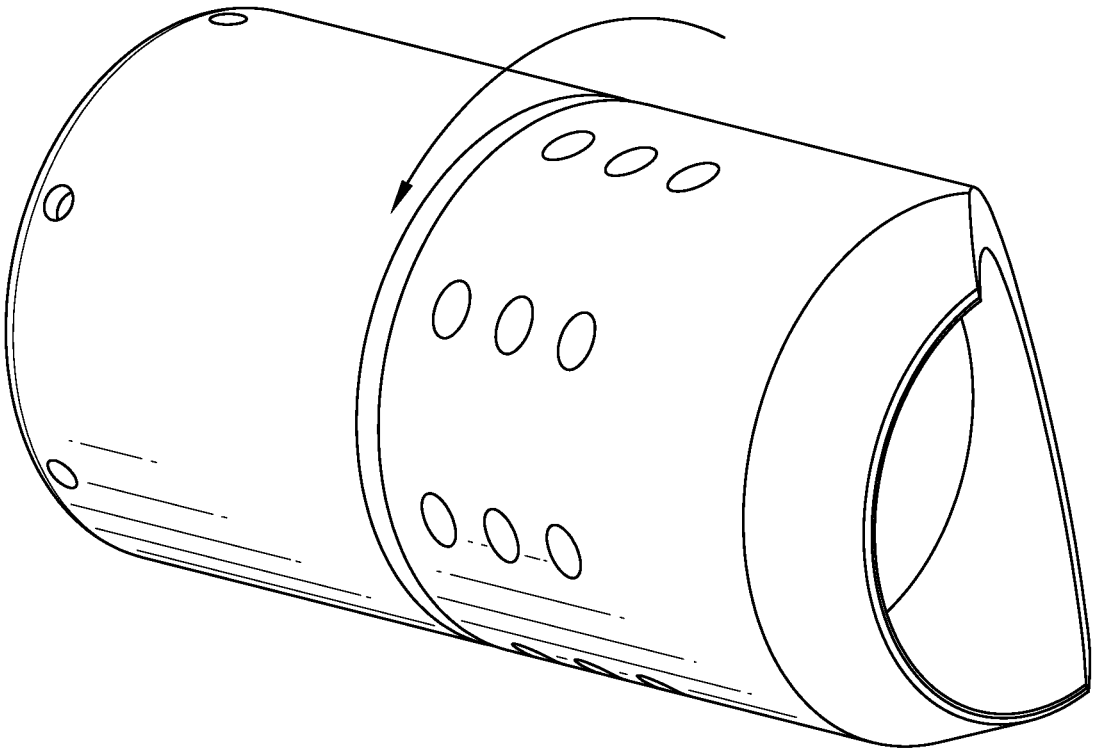
FIG. 40 shows the rotation of the tapered nose component compared to the initial position of FIG. 39.

Referring now to FIGS. 38-40, another embodiment of a tapered nose tool 140 with a shoe component 142 rotationally connected to a housing 144 is illustrated. This tool is similar to that of FIGS. 35-37 in that it rotates due to fluid flow and climbs obstructions in a wellbore tubular through which it is run due to an asymmetric leading end but differs in that the impetus for rotation is a series of ports 146 and a block 148 for fluid flow rather than the helical groove(s) of the prior embodiment. The ports 146 are arranged at other than orthogonally through a wall 150 of the shoe component 142 and all in the same angle through the wall 150 so that flowing fluid through the ports 146 will collectively generate rotation in the shoe component 142. This tool 140 is made compliant for through tubing operations by dissolving the block 148 (block may be of a degradable material) or by removing the same by shattering, etc.

Figure 41:
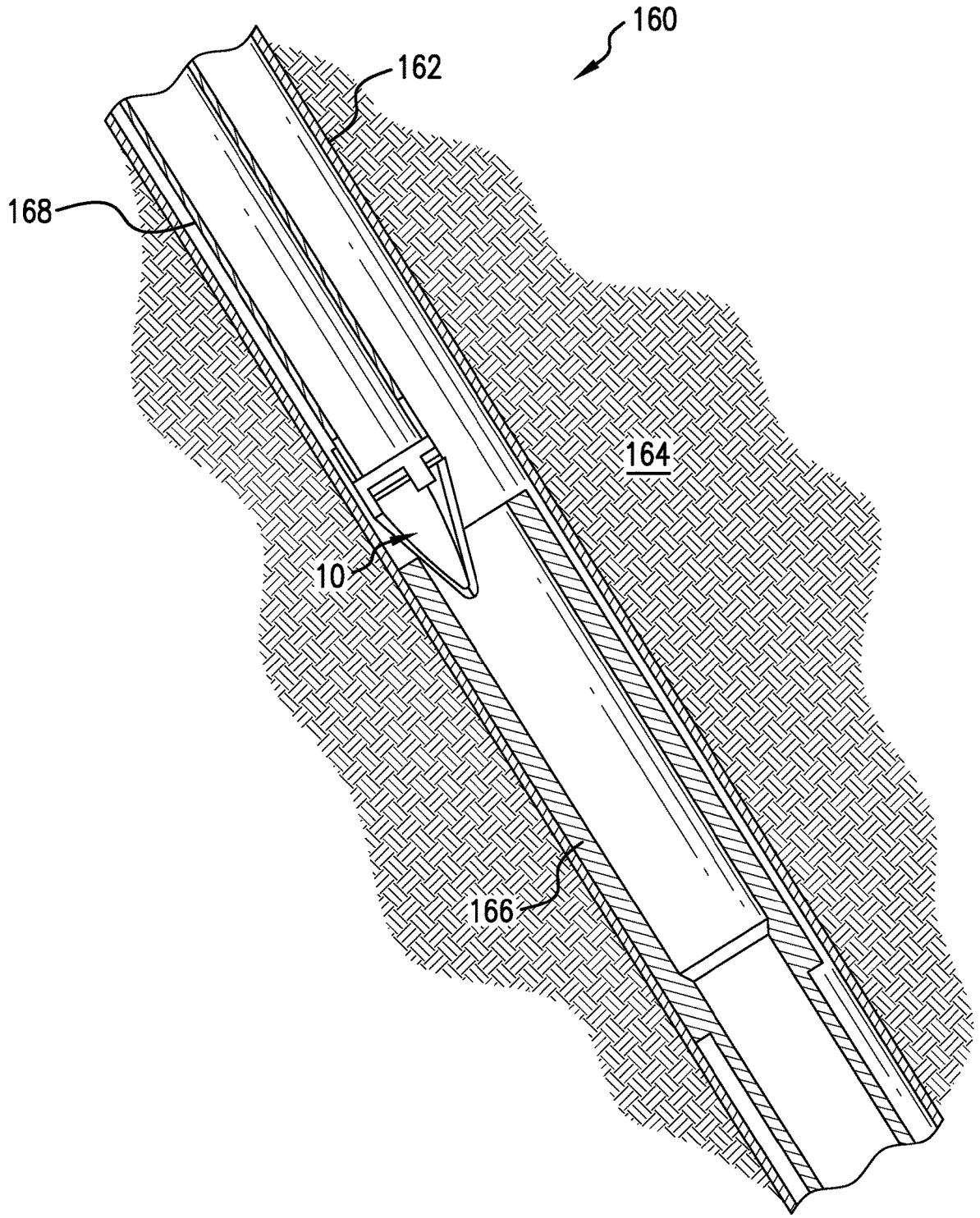
FIG. 41 is a schematic illustration of a wellbore system including a tapered nose tool as disclosed herein.

Referring to FIG. 41, a wellbore system 160 is illustrated. The system comprises a borehole wall 162 disposed in a subsurface formation 164. Within the borehole 162 is a first tubular structure 166 and a second tubular structure 168. The second tubular structure 168 is illustrated being run into the first tubular structure 166 and employs any one of the embodiments of tapered nose tool described above. Particularly illustrated for exemplary purposes is tapered nose tool 10.

Figure 42:
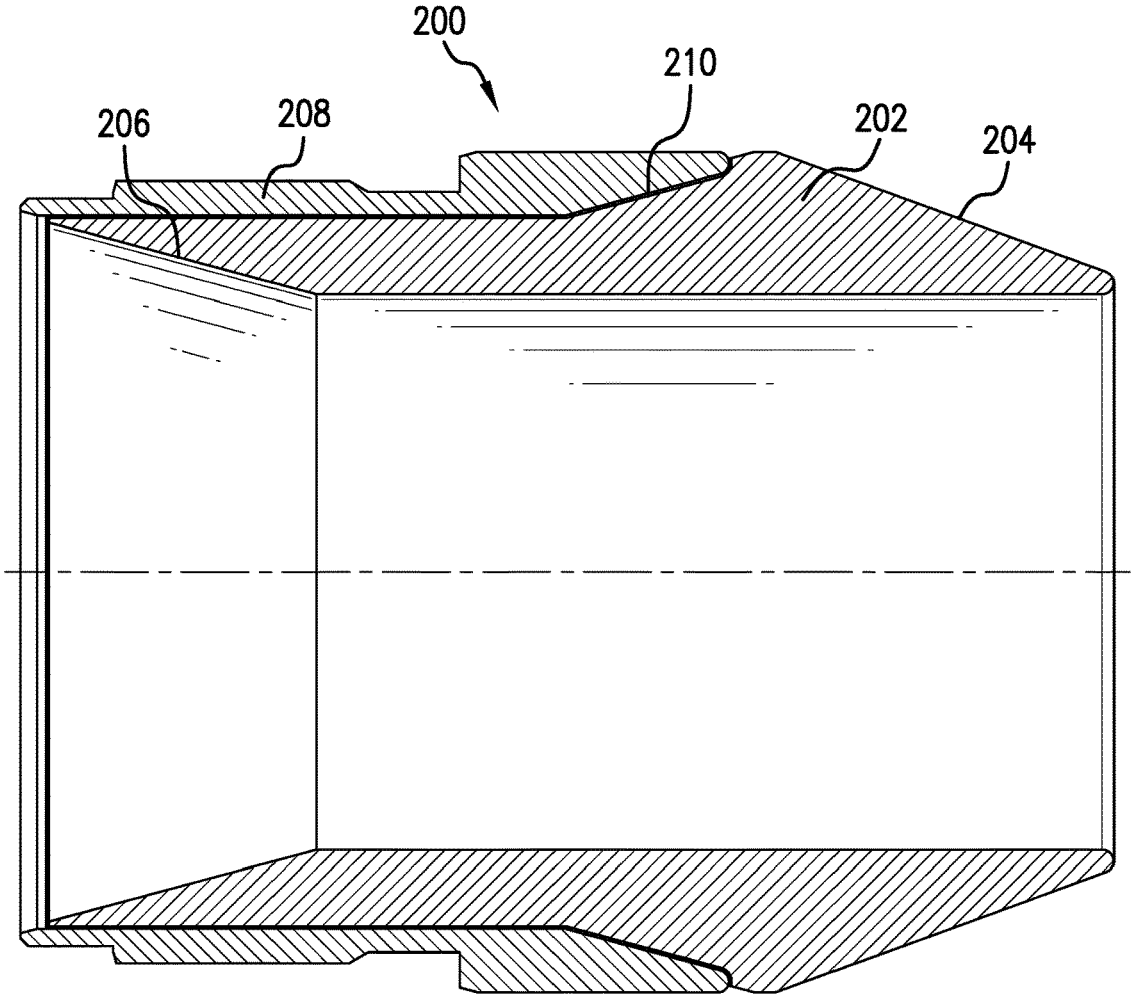
FIG. 42 is another alternative embodiment.
Figure 43:
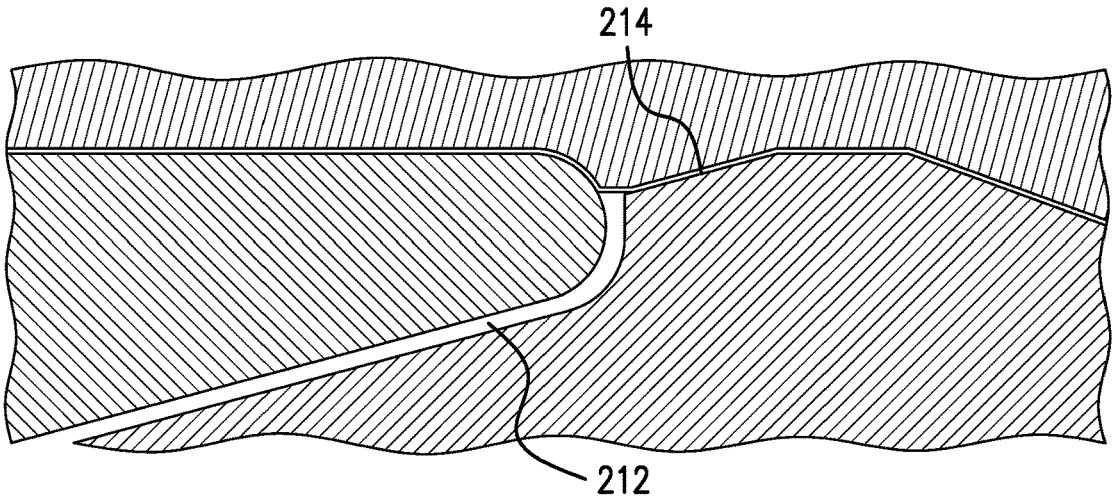
FIG. 43 is an enlarged view of a portion of FIG. 42.

Referring to FIGS. 42 and 43, another degradable embodiment of a tapered nose tool 200 having a tapered nose component 202 is illustrated. The nose component 202 features a leading taper 204 and a trailing taper 206 so that the tool 200 will easily pass through restrictions in a borehole or tubing string as in the foregoing embodiments and also allow due to the trailing taper 206 for through tubing run tools to easily exist the component 202 as well as reducing flow erosion of the component 202. The components 202 is entirely degradable and hence will disappear over a specified time frame. Once the component 202 has disappeared, a mandrel 208 is exposed. It is to be appreciated that the mandrel 208 includes a chamfered face 210 configured, positioned and oriented to facilitate the reverse circulation of a tool through the mandrel 208. FIG. 43 enlarges a portion of FIG. 42 to more clearly show a layer of adhesive 212 that is used to secure the component 202 to the mandrel 208. In embodiments using adhesive, securements such as press fitting or shrink fitting, which are also contemplated but which are a more costly manufacturing option are avoided. Finally, FIG. 43 also illustrates the coating 214 that is contiguous about the entirety of the tool 200. The coating allows greater control over when degradation of the tool 200 begins.

Figure 44:
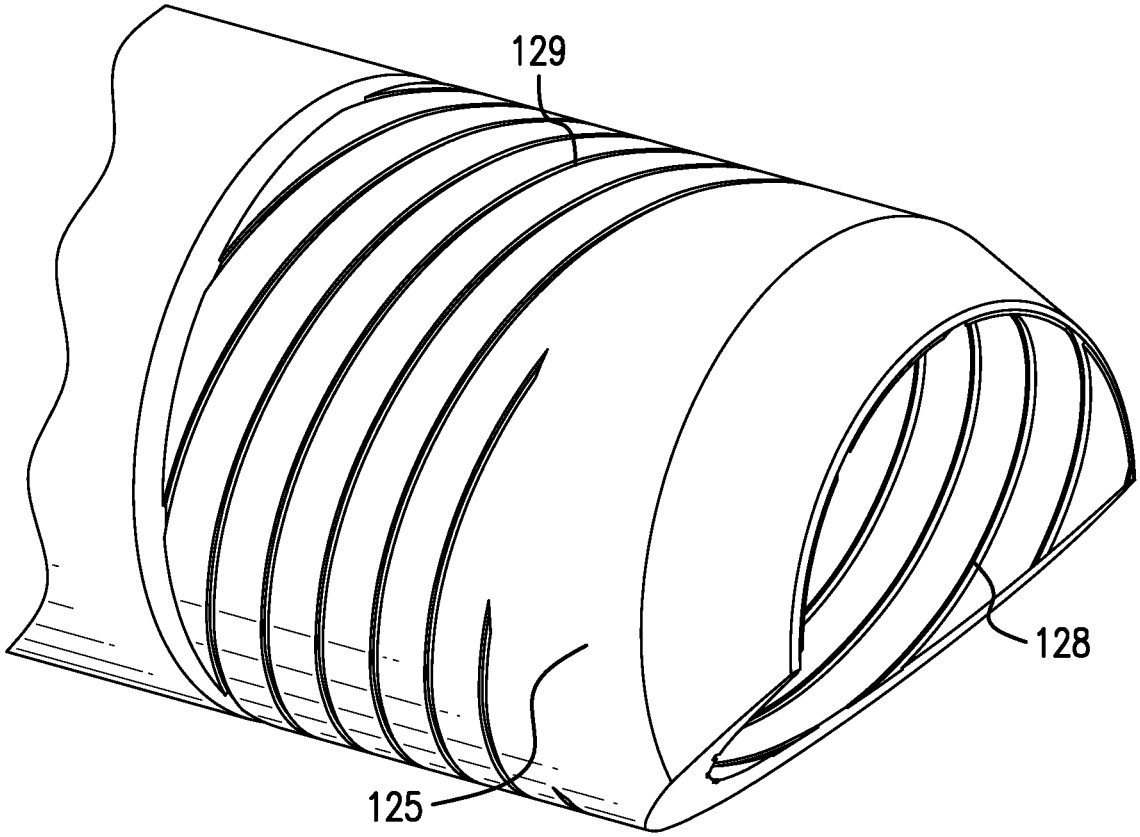
FIG. 44 is a related embodiment to that of FIGS. 35-37.
Figure 45:
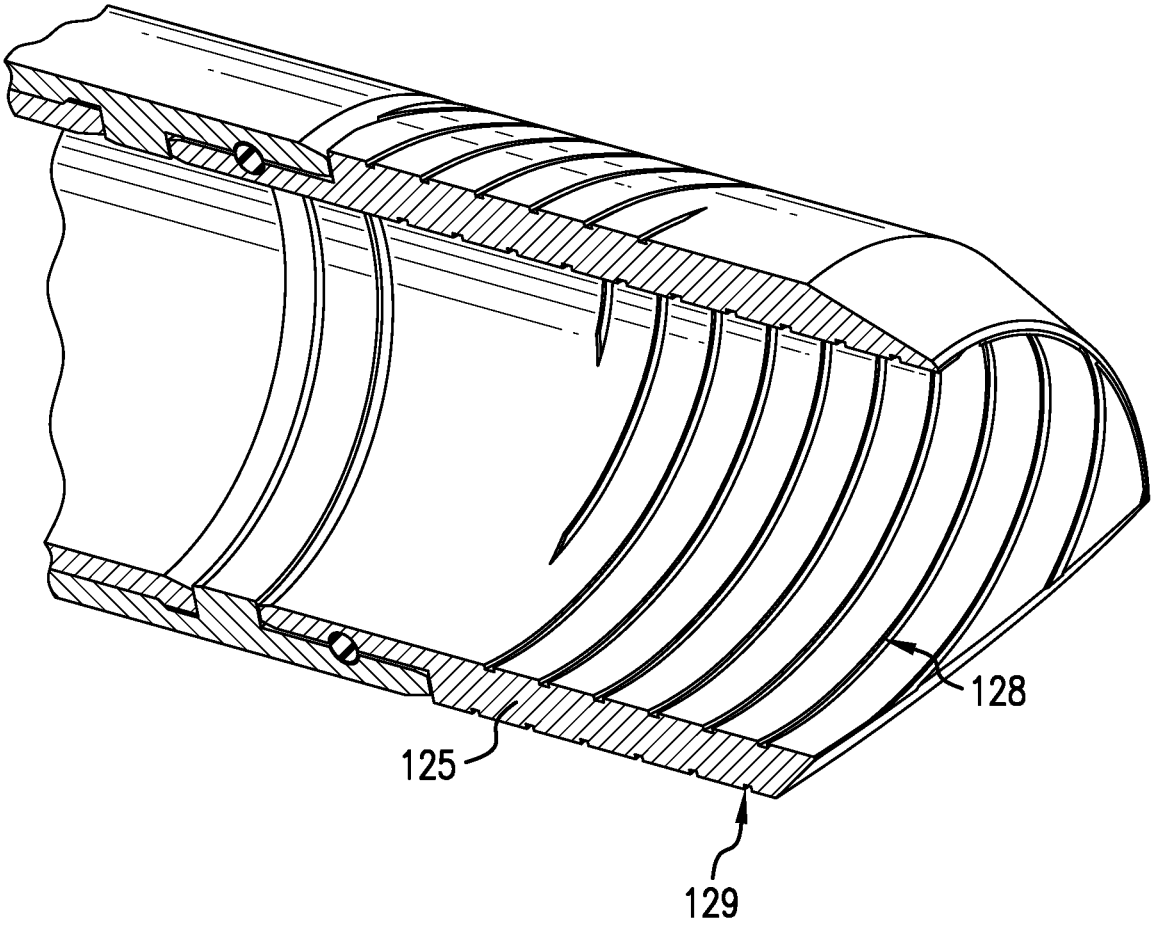
FIG. 45 is a sectional view of the embodiment of FIG. 44.

Referring to FIGS. 44 and 45, another embodiment is disclosed that is similar to the embodiment of FIGS. 35-37. The description of FIGS. 35-37 applies to this embodiment as well but the embodiment of FIGS. 44 and 45 further includes one or more outside surface helical grooves 129. The groove(s) 129 may be in addition to grooves 128 or instead of groove 128 for various configurations. The outside surface grooves 129 may further assist in causing rotation of a rotary shoe 125. In other respects, the embodiment of FIGS. 44 and 45 is the same as the embodiment of FIGS. 35-37.

Set forth below are some embodiments of the foregoing disclosure:

Embodiment 1: A pass-through tapered nose tool for a wellbore including a housing, a retrievable tapered nose disposed in the housing and retrievable from the housing.

Embodiment 2: The tool as in any prior embodiment further comprising a shiftable sleeve disposed in the housing, the sleeve anchoring the nose in the housing in a first position and releasing the nose from the housing in a second position.

Embodiment 3: The tool as in any prior embodiment, wherein the sleeve is shiftable mechanically with a shifting profile.

Embodiment 4: The tool as in any prior embodiment, wherein the sleeve includes a torque key to prevent relative rotation between the sleeve and the nose to facilitate contingency drill out of the nose.

Embodiment 5: The tool as in any prior embodiment further including a securement engagable with the housing through a securement opening of the nose.

Embodiment 6: The tool as in any prior embodiment, wherein the securement is a dog or a snap ring.

Embodiment 7: The tool as in any prior embodiment, wherein the securement is maintained in engagement with the housing by a shifting sleeve radially inwardly disposed of the nose.

Embodiment 8: The tool as in any prior embodiment, wherein the nose defines a central hole.

Embodiment 9: The tool as in any prior embodiment, wherein the nose defines flow openings.

Embodiment 10: A method for operating in a wellbore including running the tool as in any prior embodiment into a wellbore, negotiating downhole profiles with the tool, and retrieving a tapered nose of the tool.

Embodiment 11: The method as in any prior embodiment further comprising shifting a sleeve disposed radially inwardly of the tapered nose to release a securement between the tapered nose and the housing.

Embodiment 12: The method as in any prior embodiment further comprising prior to retrieving the tapered nose, flowing fluid through the tapered nose.

Embodiment 13: The method as in any prior embodiment, wherein the flowing is through a central hole defined by the tapered nose.

Embodiment 14: The method as in any prior embodiment, wherein the flowing is through a hole defined within a frustoconical surface of the tapered nose.

Embodiment 15: The method as in any prior embodiment, further comprising prior to retrieving the tapered nose, running a separate tool through the tapered nose.

Embodiment 16: A wellbore system including a borehole in a subsurface formation, a first tubular structure in the borehole, and a tool as in any prior embodiment disposed within or as a part of the first tubular structure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. A pass-through tapered nose tool for a wellbore comprising:

a housing;

a retrievable tapered nose disposed in the housing and retrievable from the housing; and a mechanically shiftable sleeve shiftable with a shifting profile disposed in the housing, the sleeve anchoring the nose in the housing in a first position and releasing the nose from the housing in a second position.

2. The tool as claimed in claim 1 wherein the sleeve includes a torque key to prevent relative rotation between the sleeve and the nose to facilitate contingency drill out of the nose.

3. The tool as claimed in claim 1 further including a securement engagable with the housing through a securement opening of the nose.

4. The tool as claimed in claim 3 wherein the securement is a dog or a snap ring.

5. The tool as claimed in claim 3 wherein the securement is maintained in engagement with the housing by a shifting sleeve radially inwardly disposed of the nose.

6. The tool as claimed in claim 1 wherein the nose defines a central hole.

7. A pass-through nose tool for a wellbore comprising:

a housing;

a retrievable tapered nose disposed in the housing and retrievable from the housing, wherein the nose defines flow openings.

8. A method for operating in a wellbore comprising:

running the tool as claimed in claim 1 into the wellbore;

negotiating downhole profiles with the tool; and retrieving a tapered nose of the tool.

9. The method as claimed in claim 8 further comprising shifting the sleeve to release a securement between the tapered nose and the housing.

10. A method for operating in a wellbore comprising:

running a tool into the wellbore, the tool having:

a housing; and a retrievable tapered nose disposed in the housing and retrievable from the housing;

negotiating downhole profiles with the tool; and retrieving a tapered nose of the tool, further comprising prior to retrieving the tapered nose, flowing fluid through the tapered nose.

11. The method as claimed in claim 10 wherein the flowing is through a central hole defined by the tapered nose.

12. The method as claimed in claim 10 wherein the flowing is through a hole defined within a frustoconical surface of the tapered nose.

13. A method for operating in a wellbore comprising:

running a tool into the wellbore, the tool having:

a housing; and a retrievable tapered nose disposed in the housing and retrievable from the housing;

negotiating downhole profiles with the tool; and retrieving a tapered nose of the tool, further comprising prior to retrieving the tapered nose, running a separate tool through the tapered nose.

14. A wellbore system comprising:

a borehole in a subsurface formation;

a first tubular structure in the borehole; and a tool as claimed in claim 1 disposed within or as a part of the first tubular structure.

* * * * *